US008979406B2

(12) United States Patent
Kasugai et al.

(10) Patent No.: US 8,979,406 B2
(45) Date of Patent: Mar. 17, 2015

(54) LABEL PRODUCING APPARATUS

(71) Applicant: Brother Kogyo Kabushiki Kaisha, Nagoya-shi, Aichi-ken (JP)

(72) Inventors: Atsushi Kasugai, Nagoya (JP); Akira Sago, Nagoya (JP); Toshiyuki Ohmori, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/848,807

(22) Filed: Mar. 22, 2013

(65) Prior Publication Data

US 2013/0209154 A1 Aug. 15, 2013

Related U.S. Application Data

(63) Continuation-in-part of application No. PCT/JP2011/079108, filed on Dec. 5, 2011.

(30) Foreign Application Priority Data

Dec. 28, 2010 (JP) ..... 2010-294089

(51) Int. Cl.
*B41J 11/00* (2006.01)
*B31D 1/02* (2006.01)
(Continued)

(52) U.S. Cl.
CPC ... *B31D 1/02* (2013.01); *B41J 2/32* (2013.01); *B41J 3/4075* (2013.01); *B65H 35/06* (2013.01);
(Continued)

(58) Field of Classification Search
USPC ..... 400/611, 621, 593; 83/321, 602, 596, 83/603, 648, 694, 597; 283/104
See application file for complete search history.

(56) References Cited

U.S. PATENT DOCUMENTS

| | | | | |
|---|---|---|---|---|
| 6,705,784 | B2 | 3/2004 | Furuya et al. | |
| 2005/0031397 | A1 | 2/2005 | Miki et al. | |
| 2007/0147939 | A1 * | 6/2007 | Moriyama et al. | 400/621 |

FOREIGN PATENT DOCUMENTS

| | | |
|---|---|---|
| JP | 62029258 | 2/1987 |
| JP | 62092878 | 4/1987 |

(Continued)

OTHER PUBLICATIONS

International Report on Patentability issued in Application No. PCT/JP2011/079108 on Jul. 18, 2013.

(Continued)

*Primary Examiner* — Matthew G Marini
(74) *Attorney, Agent, or Firm* — McCarter & English, LLP

(57) ABSTRACT

The disclosure discloses a label producing apparatus. The label producing apparatus includes a cartridge holder, a feeder, a movable blade, a driving roller configured to contact and discharge the label tape, a driven roller provided so that it can advance and retreat between a contact position and a separated position, a motor configured to rotate in a single direction only and generate a driving force of the movable blade, and a rotational movement of the driving roller, a gear mechanism configured to transmit the driving force to the driving roller, and an advancing and retreating adjustment device configured to adjust an movement of the driven roller and the movable blade, associated with a rotation of the motor, the adjustment device advancing and retreating the driven roller and the movable blade so that the driven roller is in the contact position for a predetermined time period after cutting.

11 Claims, 26 Drawing Sheets

(51) Int. Cl.

| | |
|---|---|
| ***B41J 2/32*** | (2006.01) |
| ***B41J 3/407*** | (2006.01) |
| ***B65H 35/06*** | (2006.01) |
| ***B41J 11/70*** | (2006.01) |
| ***B41J 13/02*** | (2006.01) |
| ***B26D 5/00*** | (2006.01) |
| *B26D 1/30* | (2006.01) |
| *B26D 5/14* | (2006.01) |
| *B26D 7/00* | (2006.01) |

(52) U.S. Cl.

CPC ..... *B41J 11/703* (2013.01); *B41J 13/025* (2013.01); *B26D 5/00* (2013.01); *B26D 1/305* (2013.01); *B26D 5/14* (2013.01); *B26D 2007/005* (2013.01); *B65H 2701/192* (2013.01)

USPC ..... 400/621; 83/602; 400/611

(56) References Cited

FOREIGN PATENT DOCUMENTS

| | | |
|---|---|---|
| JP | 63-133556 | 9/1988 |
| JP | 2003237155 | 8/2003 |
| JP | 2005053093 | 3/2005 |
| JP | 2005053096 | 3/2005 |
| JP | 4405067 | 1/2010 |
| JP | 2010082817 | 4/2010 |

OTHER PUBLICATIONS

Japanese Office Action issued in Application No. 2010-294089 on Dec. 26, 2013.

* cited by examiner

LABEL PRODUCING APPARATUS

CROSS-REFERENCE TO RELATED APPLICATION

This is a CIP application PCT/JP2011/079108, filed Dec. 15, 2011, which was not published under PCT article 21(2) in English.

BACKGROUND

1. Field

The present disclosure relates to a label producing apparatus for producing a label to be used affixed to a target object.

2. Description of the Related Art

Heretofore, there have been known label producing apparatuses configured to produce labels. In this label producing apparatus (tape printing apparatus) of prior art, a cartridge (tape cassette) around which a label tape (tape) is wound into a roll shape is mounted. Preferred printing is performed by printing device (a thermal head) provided to the label producing apparatus on the tape fed out from the roll inside the cartridge, thereby forming a label tape with print. Subsequently, the tag label tape with print is cut at a preferred length by a cutting mechanism, thereby generating a label with print. The generated label is discharged to the outside of the apparatus by a tape discharging mechanism positioned further on the downstream side in the transport direction than the cutting mechanism.

The cutting mechanism at this time comprises a movable blade capable of advancing and retreating with respect to the transport path of the tape by the driving force of a cutter motor, and a fixed blade provided on the side opposite the movable blade with the tape transport path therebetween. Further, the tape discharging mechanism comprises a driving roller that is driven by the rotational driving force of the tape discharging motor, and a driven roller (pressure roller) for inserting a label between itself and the driving roller and discharging the label.

According to the above prior art, two motors, a motor (cutter motor) for driving a movable blade of a cutting mechanism and a motor (tape discharging motor) for driving a driving roller of the tape discharging mechanism, are provided separately. As a result, the number of motors increases, leading to an increased size and weight of the overall apparatus.

SUMMARY

It is therefore an object of the present disclosure to provide a label producing apparatus capable of decreasing the number of motors, thereby achieving a reduction in the size and weight of the overall apparatus.

In order to achieve the above-described object, according to the aspect of the present application, there is provided a label producing apparatus. The label producing apparatus comprises a cartridge holder capable of attaching and detaching a cartridge configured to supply a label tape, a feeder configured to pull out and feed the label tape from the cartridge mounted to the cartridge holder, a movable blade configured to advance and retreat with respect to a tape transport path by the feeder, and cut the label tape fed by the feeder at a desired length, a driving roller configured to contact and discharge the label tape, provided further on a downstream side than the movable blade on the tape transport path, a driven roller provided so that it can advance and retreat between a contact position where it can contact the label tape positioned on the tape transport path with the driving roller from an opposite side and insert the label tape between itself and the driving roller, and a separated position where it separates from the label tape positioned on the tape transport path in an amount equivalent to a predetermined distance, a motor configured to rotate in a single direction only and generate a driving force for an advancing and retreating movement of the movable blade with respect to the tape transport path, and a rotational movement of the driving roller, a gear mechanism configured to transmit the driving force of the motor to the driving roller so that the driving roller rotates along with a rotational movement of the motor, and an advancing and retreating adjustment device configured to adjust an advancing and retreating movement of the driven roller with respect to the driving roller and an advancing and retreating movement of the movable blade with respect to the tape transport path, associated with a rotation of the motor in the single direction, to a desired mode in coordination with each other, the advancing and retreating adjustment device advancing and retreating the driven roller and the movable blade in coordination so that the driven roller is in the contact position for a predetermined time period after cutting of the label tape is completed by the movable blade.

In the aspect of the present disclosure, the label tape is pulled out from the cartridge mounted to the cartridge holder and fed on the transport path by feeder. The cutting blade then advances toward the label tape fed to a suitable cutting position and cuts the label tape at a preferred length, thereby forming the label. The driving roller contacts the label thus produced and discharges the label to outside the apparatus. At the time of that discharge, the driven roller inserts the label tape between itself and the driving roller and, with the driving roller and driven roller operating in coordination, the label is discharged.

Here, in the aspect of the present disclosure, the rotational driving of the driving roller and the advancing and retreating movement of the movable blade are performed by the driving force from a single common motor. First, the driving roller is directly connected to and rotates with the rotational driving of the motor in a single direction via a gear mechanism, and thus always rotates when the motor is rotationally driven. At this time, the driven roller is provided so that it can advance and retreat between a contact position and a separated position. When in the contact position, the driven roller inserts the label tape between itself and the driving roller as previously described. As a result, the rotational driving force of the driving roller acts on the label tape via a friction force, feeding the label tape in the discharging direction. Conversely, in a case where the driven roller is in the separated position, the driven roller and the driving roller are separated (by a distance greater than the thickness of the tape). As a result, the friction force between the driving roller and label tape substantially no longer acts on the label tape and thus, even if the driving roller rotates due to the rotational driving of the motor as described above, that rotational driving force is not transmitted to the label tape, and the label tape is not discharged.

On the other hand, the cutting of the label tape by the advancing and retreating movement of the moveable blade with respect to the tape transport path is also performed by utilizing the driving force of the above type of motor. Further, when tape cutting is completed, the label tape is inserted between the driven roller and the driving roller and the driving force is transmitted to the label tape, making it possible to feed the cut label tape, that is, the label, in the discharging direction. Furthermore, with the contact of the label tape by the driven roller maintained for a predetermined time period after cutting is completed, the discharging movement of the label continues for the predetermined time period. As a result, it is possible to reliably discharge the label generated by the cutting to outside the apparatus by sufficiently lengthening the predetermined time period.

As described above, in the aspect of the present disclosure, it is possible to smoothly and reliably cut a label tape by a movable blade and subsequently discharge a label utilizing the driving force of a single common motor. Accordingly, compared to a case where two motors, a motor for driving a movable blade and a motor for discharging the label, are provided separately, it is possible to decrease the number of motors. As a result, the size and weight of the overall apparatus can be reduced, and a cost reduction can also be achieved.

DETAILED DESCRIPTION OF PREFERRED EMBODIMENTS

The following describes one embodiment of the present disclosure with reference to accompanying drawings.

Figure 1:
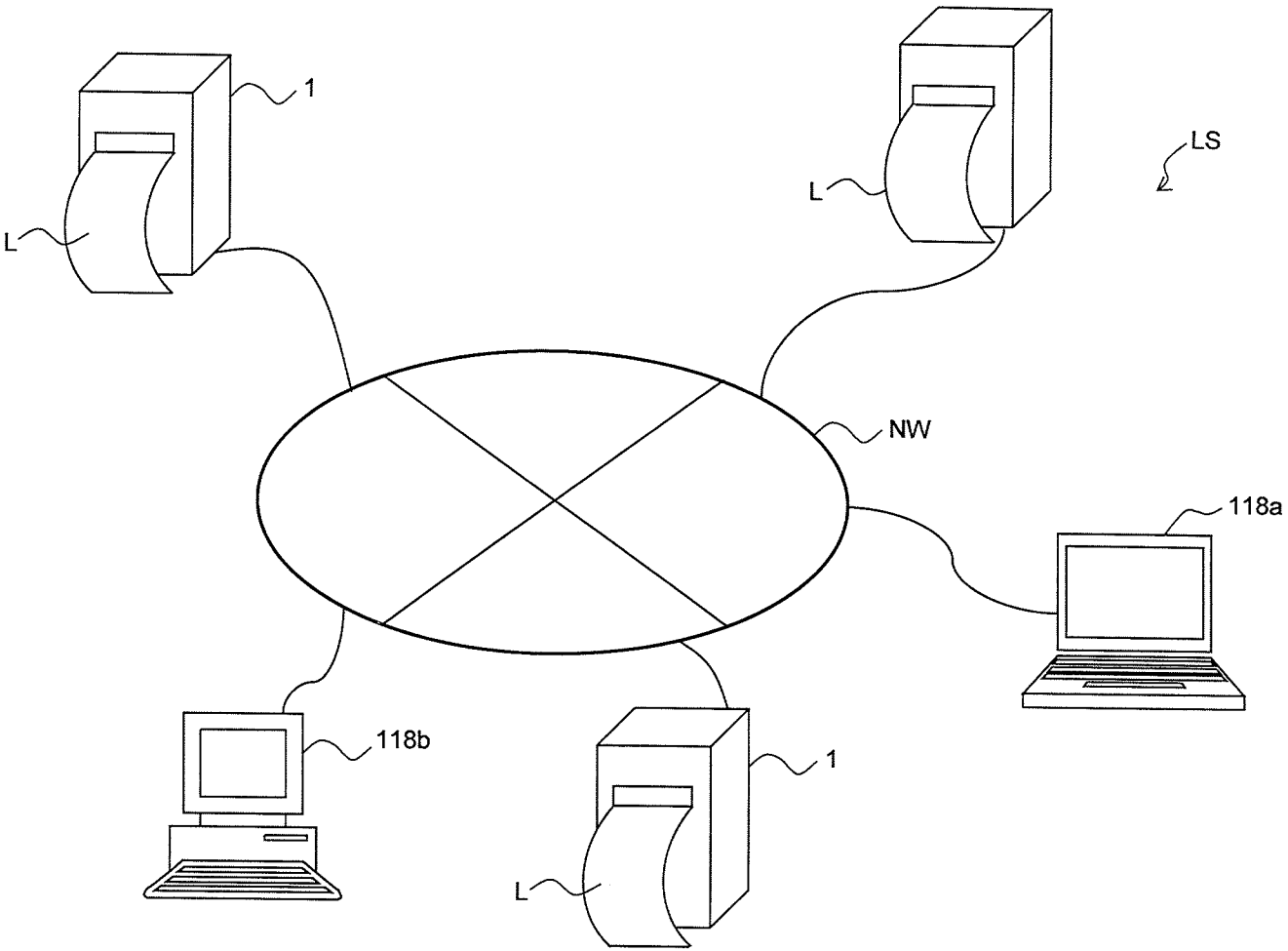
FIG. 1 is a system configuration diagram showing a label manufacturing system comprising an embodiment of the label producing apparatus of the present disclosure.

In a label manufacturing system LS shown in FIG. 1, a label producing apparatus 1 of this embodiment is connected to a terminal 118*a* and a general-purpose computer 118*b* via a communication line NW in a wired or wireless manner in this example. Note that the terminal 118*a* and the general-purpose computer 118*b* will hereinafter be suitably and simply referred to as a "PC 118" collectively. The label producing apparatus 1, in this example, produces a label with preferred print based on an operation from the above described PC 118.

Figure 2:
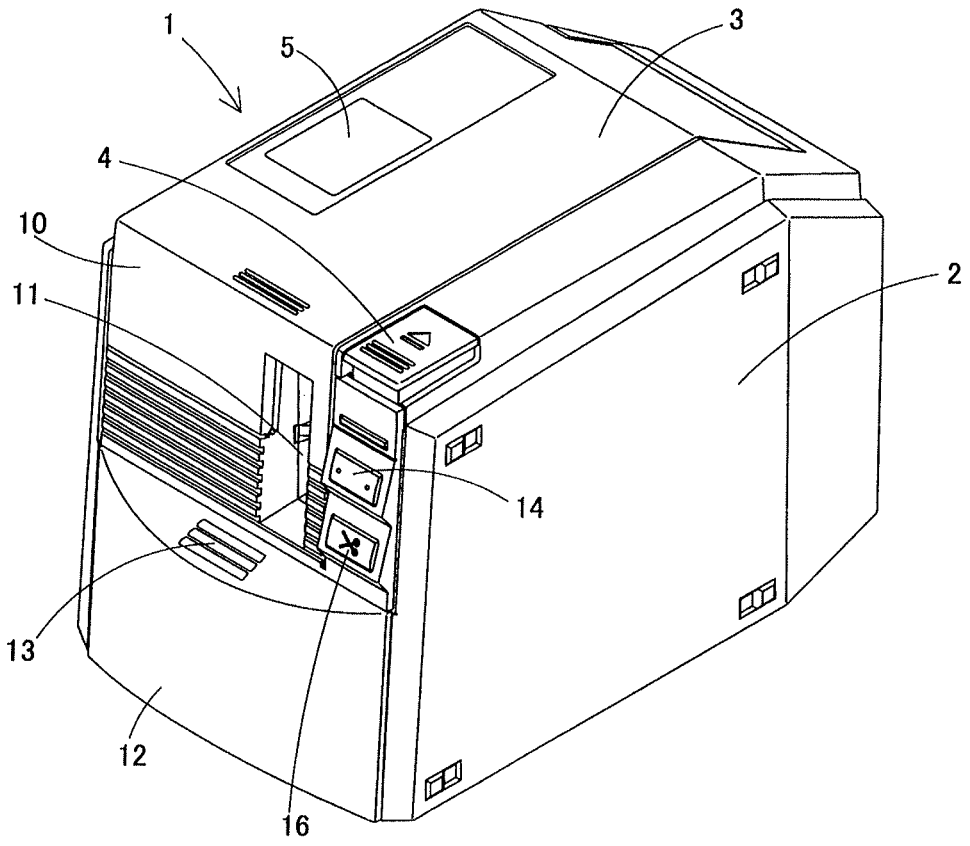
FIG. 2 is a perspective view showing the overall structure of the label producing apparatus.

As shown in FIG. 2, the label producing apparatus 1 comprises an apparatus main body 2 and an opening/closing lid 3 provided to a top side of this apparatus main body 2 in an openable and closeable manner.

The apparatus main body 2 comprises a front wall 10, which is positioned at the front side (the left front side in FIG. 2) and comprises a label discharging exit 11 configured to discharge a label L produced inside the apparatus main body 2 to the outside, and a front lid 12 with a rotationally supported bottom end that is provided below the label discharging exit 11 on the front wall 10.

The front lid 12 comprises a pressing part 13, which is designed to release the front lid 12 forward when pressed from above. Further, a power button 14 that turns the power source of the label producing apparatus 1 on and off is provided to one end of the front wall 10. A cutter driving button 16 for driving a cutting mechanism 15 (refer to FIG. 3 described later) provided inside the apparatus main body 2 by a manual operation performed by the user is provided below the power button 14, and is designed to cut a label tape 109 with print (details described later) when pressed so as to detach the label L from the apparatus main body.

The opening/closing lid 3 is rotatably supported by a shaft at the end of the right rear side in FIG. 2 of the apparatus main body 2, and is always biased in the release direction via a biasing member such as a spring, etc. Then, the opening/closing lid 3 and the apparatus main body 2 are unlocked by the pressing of an open/close button 4 disposed adjacent to the opening/closing lid 3 on the top side of the apparatus main body 2, and released by the action of the above described biasing member. Furthermore, an inspection window 5 covered by a transparent cover is provided in the center side area of the opening/closing lid 3.

Internal Unit

Figure 3:
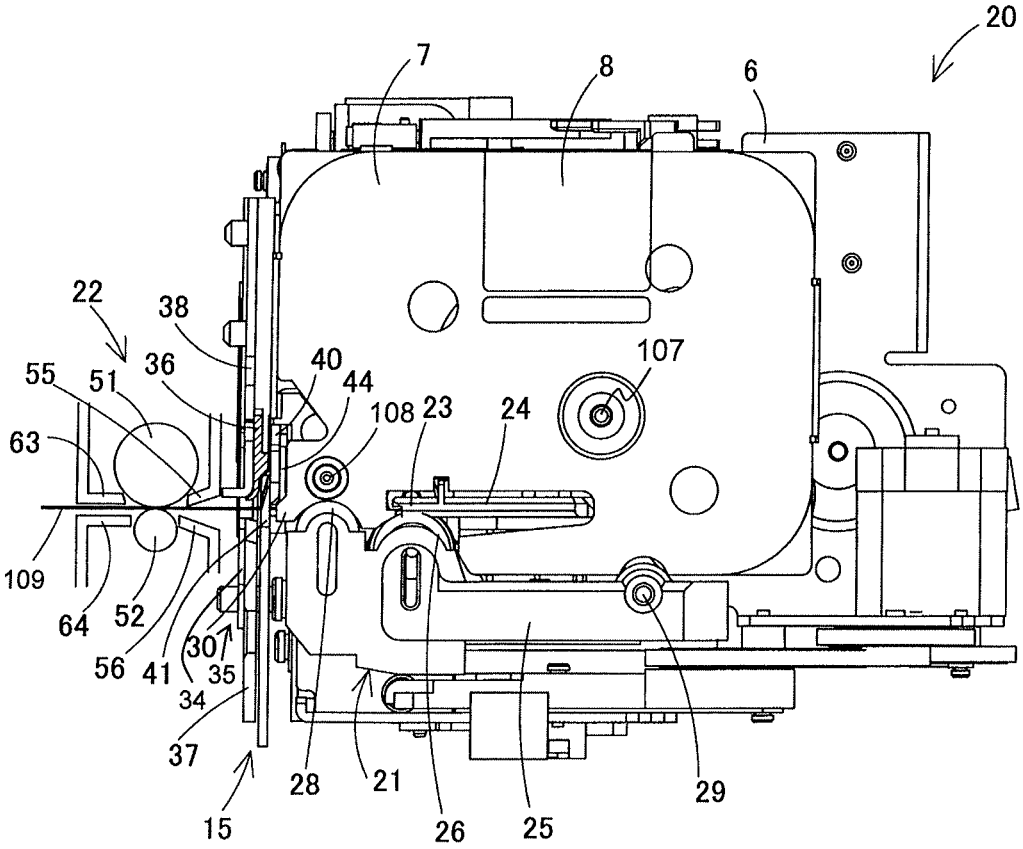
FIG. 3 is a plan view showing the structure of the internal unit.

Next, the structure of an internal unit 20 in the interior of the label producing apparatus 1 will be described. The internal unit 20, as shown in FIG. 3, schematically comprises a cartridge holder 6 configured to house a cartridge 7, a printing mechanism 21 comprising a print head 23, the cutting mechanism 15 as a cutter, a half-cutting unit 35 comprising a half-cutter 34, and a label discharging mechanism 22 configured to discharge the generated label L from the label discharging exit 11 (refer to FIG. 2).

Cartridge Holder and Printing Mechanism

The cartridge holder 6 houses the cartridge 7 so that the orientation of the width direction of the label tape 109 with print to be discharged from the label discharging exit 11 (refer to FIG. 2) is orthogonal.

Figure 4:
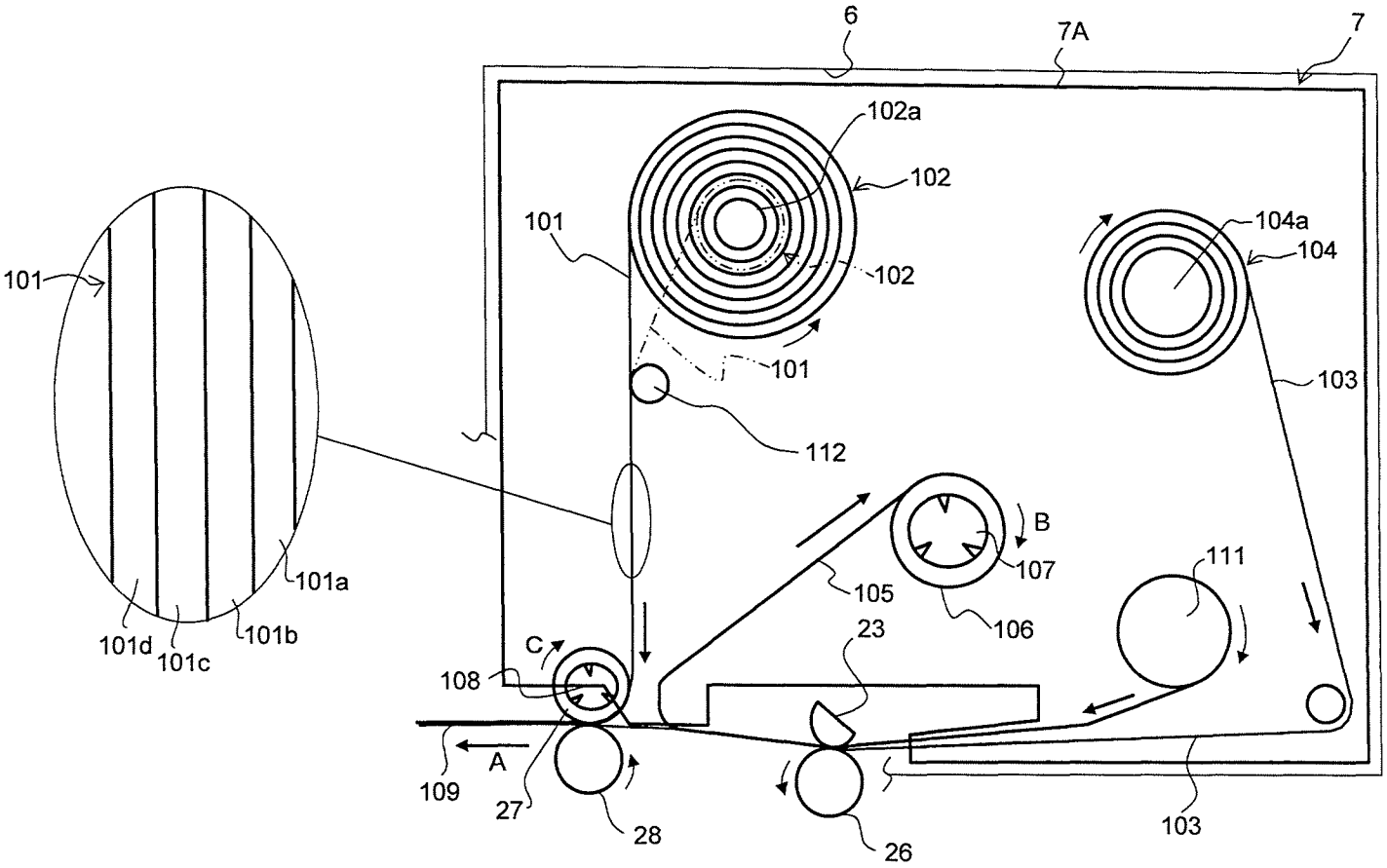
FIG. 4 is an enlarged plan view schematically showing the detailed structure of a cartridge.
Figure 5:
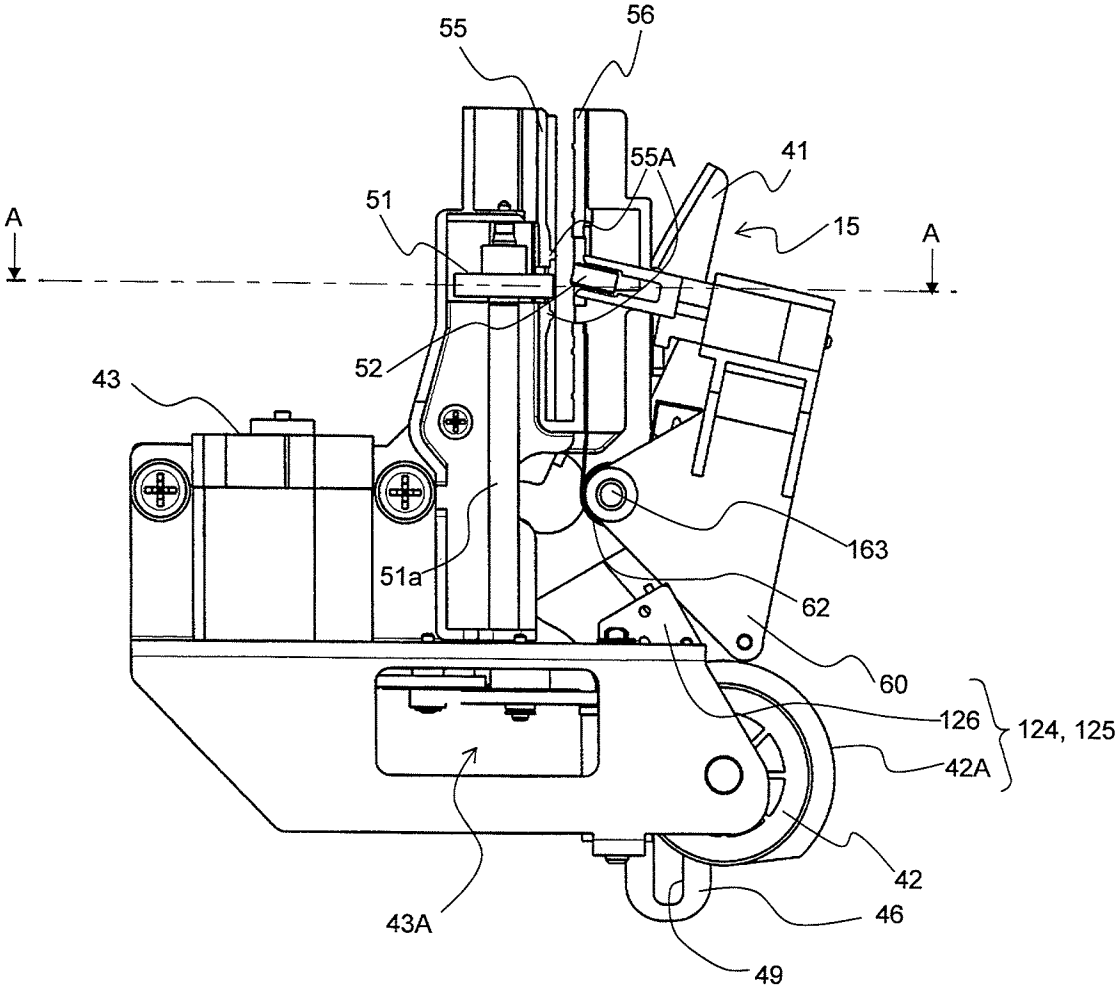
FIG. 5 is a front view of the discharging mechanism and cutting mechanism of the internal unit, as viewed from the downstream side in the tape transport direction.
Figure 6:
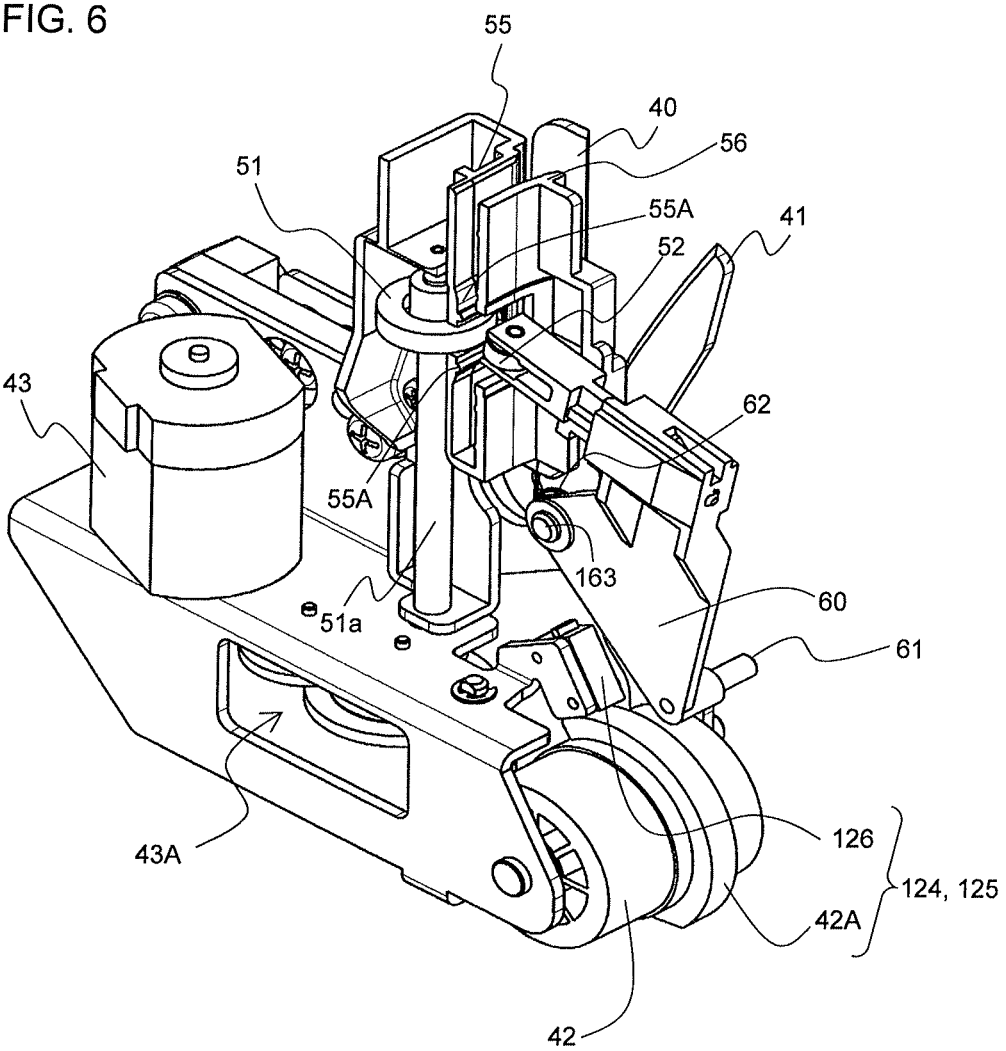
FIG. 6 is a perspective view of the discharging mechanism and cutting mechanism of the internal unit, as viewed from the downstream side in the tape transport direction.
Figure 7:
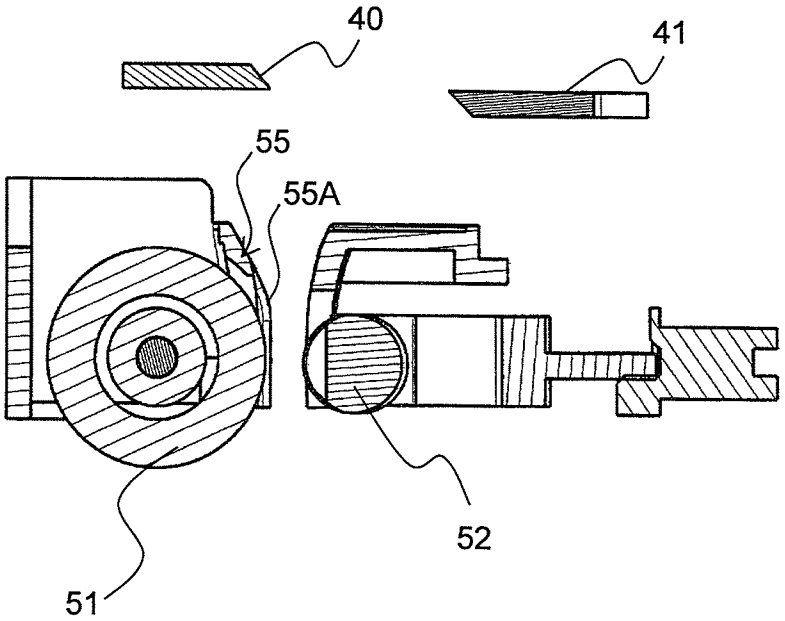
FIG. 7 is a horizontal sectional view taken along a line A-A in FIG. 5.

Next, the detailed structure of the cartridge 7 will be described. As shown in FIG. 4 and FIG. 3, the cartridge 7 comprises a housing 7A, a first roll 102 disposed inside the housing 7A and around which a tape-shaped base tape 101 is wound, a second roll 104 around which a clear cover film 103 with substantially the same width as the above described base tape 101 is wound, a ribbon supply side roll 111 configured to feed out an ink ribbon 105 (thermal transfer ribbon, but unneeded if the print-receiving tape is thermal tape), a ribbon take-up roller 106 for taking up the ribbon 105 after printing, a feeding roller 27 rotatably supported near a tape discharging part 30 of the cartridge 7, and a guide roller 112.

The feeding roller 27 is configured to adhere the above described base tape 101 and the above described cover film 103 to each other by applying pressure and feeding the above described label tape 109 with print in the direction of an arrow A (i.e. functioning as a pressure roller as well).

The first roll 102 has the above described base tape 101 wound around a reel member 102*a*. In this example, the base tape 101 comprises a four-layer structure (refer to the partially enlarged view in FIG. 4) comprising an adhesive layer 101*a* made of a suitable adhesive material, a colored base film 101*b* made of PET (polyethylene terephthalate) or the like, an adhesive layer 101*c* made of a suitable adhesive material, and a separation sheet 101*d*. The four layers of the base tape 101 are layered in that order from the side rolled to the inside (the right side in FIG. 4) to the opposite side (the left side in FIG. 4).

The above described adhesive layer 101*a* is formed on the front side of the base film 101*b* (the right side in FIG. 4) for adhering the cover film 103 thereon at a later time. The above described separation sheet 101*d* is also adhered to the back side (the left side of FIG. 4) of the base film 101*b* by the above described adhesive layer 101*c*.

The separation sheet 101*d* is eventually peeled off when the label L is to be affixed as a finished label-like product to a desired article or the like, making it possible to adhere the label L to the article or the like by the adhesive layer 101*c*.

The second roll 104 has the above described cover film 103 wound around a reel member 104*a*. The cover film 103 fed out from the second roll 104 is pressed against the ribbon 105 driven by the above described ribbon supply side roll 111 and the above described ribbon take-up roller 106, which are disposed inward from the back side of the cover film 103 fed out from the second roll 104 (i.e., the side of the cover film 103 which is adhered to the above described base tape 101), by the above described print head 23, such that the ribbon 105 is brought into close contact with the back side of the cover film 103.

The ribbon take-up roller 106 and the feeding roller 27 are rotationally driven in coordination by the driving force of a feeding motor 119 (refer to FIG. 10 described later), which is a pulse motor, for example, provided on the outside of each of the cartridges 7, that is transmitted to a ribbon take-up roller driving shaft 107 and a feeding roller driving shaft 108 via a gear mechanism (not shown).

Meanwhile, the above described print head 23 comprising a great number of heating elements is mounted to a head mounting part 24 provided in a standing condition on the cartridge holder 6, and is disposed on the upstream side in the transport direction of the cover film 103 than the feeding roller 27.

In front of the cartridge 7 of the cartridge holder 6 (on the lower side in FIG. 3), a roller holder 25 is rotatably pivoted by a support shaft 29, and is designed so as to be switchable between a print position (refer to FIG. 3) and a release position by a switching mechanism. A platen roller 26 and a tape pressure roller 28 are rotatably provided to this roller holder 25. When the roller holder 25 switches to the above described print position, the platen roller 26 and the tape pressure roller 28 press against the above described print head 23 and the above described feeding roller 27.

In the above described configuration, the cartridge 7 is mounted to the above described cartridge holder 6, and the base tape 101 fed out from the above described first roll 102 is supplied to the feeding roller 27. On the other hand, on the back side of the cover film 103 fed out from the second roll 104 as previously described, the ink ribbon 105 is pressed against and made to contact the above described print head 23. When the roller holder 25 is moved from the above described release position to the above described print position, the cover film 103 and the ink ribbon 105 are sandwiched between the print head 23 and the platen roller 26, while the base tape 101 and the cover film 103 are sandwiched between the feeding roller 27 and the pressure roller 28. Then, the ribbon take-up roller 106 and the feeding roller 27 are synchronously rotationally driven along the directions denoted by an arrow B and an arrow C, respectively, in FIG. 4, by the driving force of the feeding motor 119. The aforementioned feeding roller driving shaft 108, the above described pressure roller 28, and the platen roller 26 are connected to one another at this time by a gear mechanism (not shown). With such an arrangement, upon driving the feeding roller driving shaft 108, the feeding roller 27, the pressure roller 28, and the platen roller 26 rotate, thereby feeding out and supplying the base tape 101 from the first roll 102 to the feeding roller 27 as previously described. On the other hand, the cover film 103 is fed out from the second roll 104, and a plurality of heating elements of the print head 23 are powered by a print-head driving circuit 120 (refer to FIG. 10 described later). As a result, a label print R (refer to FIG. 11 described later) is printed on the back side of the cover film 103. Then, the above described base tape 101 and the above described printed cover film 103 are adhered to each other by the above described feeding roller 27 and the pressure roller 28 so as to form a single tape, thereby forming the label tape 109 with print, which is then fed to outside the cartridge 7 via the tape discharging part 30. The ribbon take-up roller driving shaft 107 is then driven to rewind the ink ribbon 105, with which printing to the cover film 103 was completed, onto the ribbon take-up roller 106.

A tape identification display part 8 (refer to FIG. 3) configured to display the tape width, tape color, etc., of the above described base tape 101 built into the cartridge 7 is provided on the top side of the above described housing 7A of the cartridge 7, for example.

On the other hand, as previously described, the internal unit 20 is provided with the above described cutting mechanism 15 and the above described label discharging mechanism 22. The above described cutter driving button 16 (refer to FIG. 2) is operated with respect to the label tape 109 with print bonded and generated as previously described, causing the label tape 109 with print to be cut by the cutting mechanism 15 (or to be automatically cut based on suitable timing), thereby generating the label L. This label L is subsequently further discharged from the above described label discharging exit 11 formed on the front wall 10 (refer to FIG. 2), by the label discharging mechanism 22.

Cutting Mechanism

Next, the cutting mechanism 15 will be described with reference to FIGS. 5-9 and the above described FIG. 3. Note that FIGS. 5-9 exclude the half-cutting unit described later to avoid complexities in illustration. Note that a configuration that omits the half-cutting unit as illustrated in these figures is also acceptable.

As a result of bonding such as previously described, in the label tape 109 with print, the cover film 103, the adhesive layer 101*a*, the base film 101*b*, the adhesive layer 101*c*, and the separation sheet 101*d* are layered along the layering direction, in that order. The cutting mechanism 15 cuts all of these layers, thereby producing the print label L comprising the above described print. That is, the cutting mechanism 15 comprises a fixed blade 40, a movable blade 41 that performs a cutting movement along with this fixed blade 40, a cutter helical gear 42 that engages with this movable blade 41, and a driving motor 43 that is operably linked by a gear train 43A made of a plurality of gears to the cutter helical gear 42 and rotates in a single direction.

Figure 8:
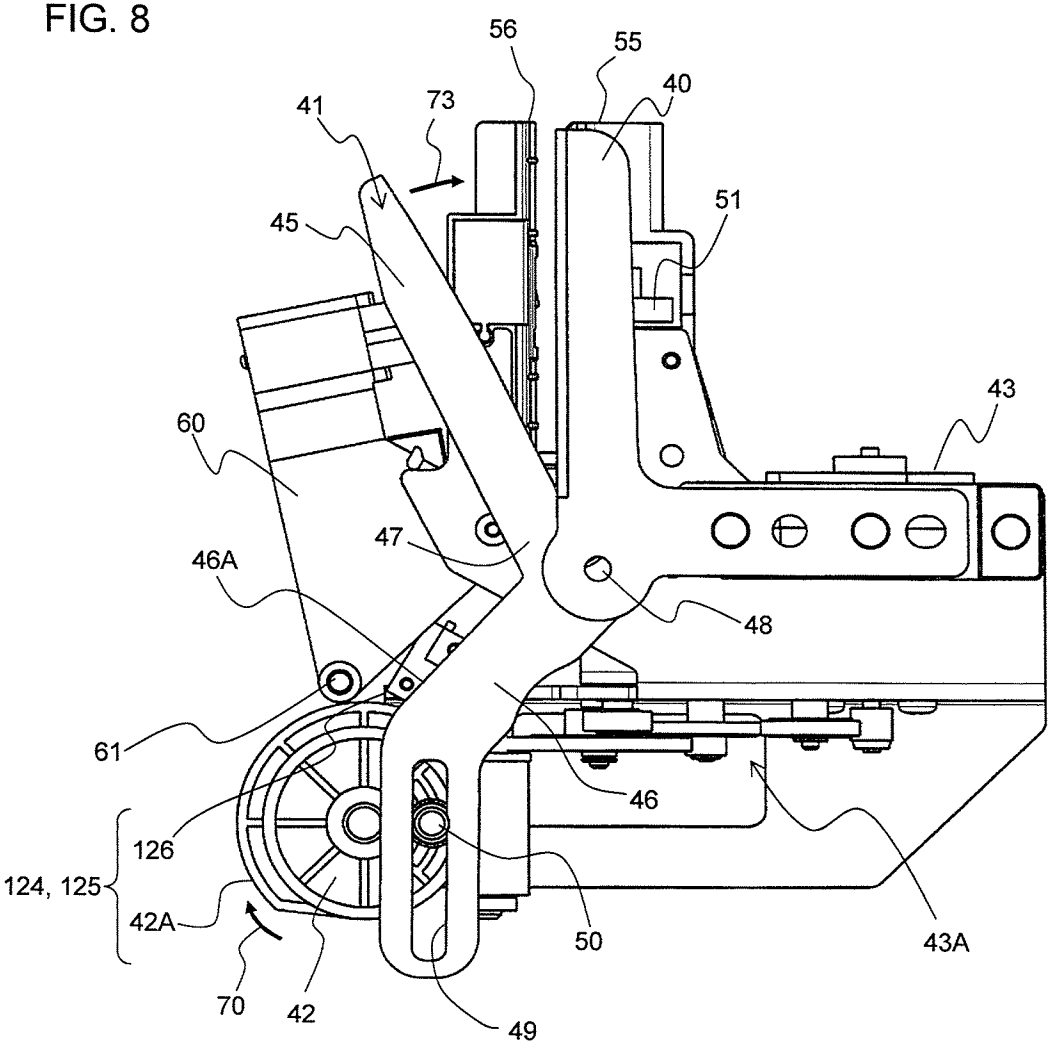
FIG. 8 is a rear view of the discharging mechanism and cutting mechanism of the internal unit, as viewed from the upstream side in the tape transport direction.
Figure 9:
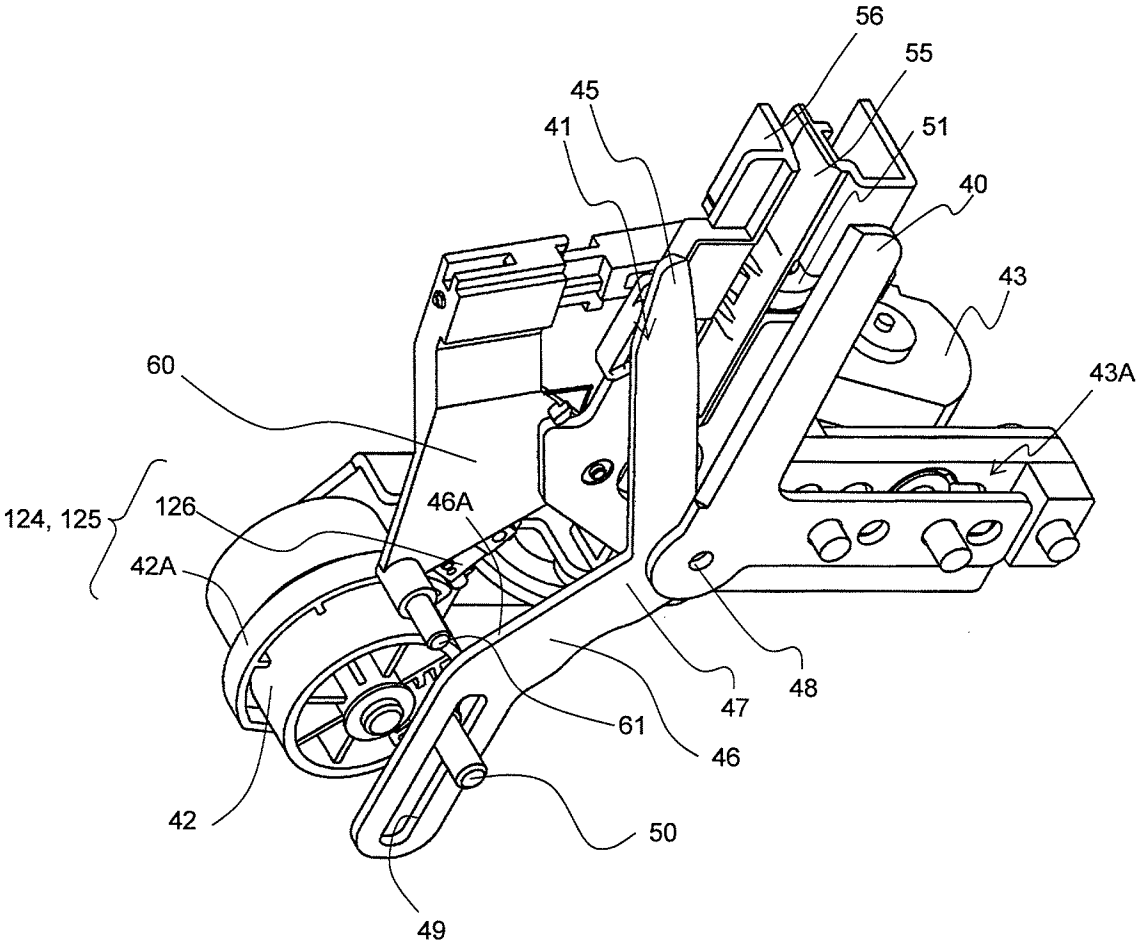
FIG. 9 is a perspective view of the discharging mechanism and cutting mechanism of the internal unit, as viewed from the upstream side in the tape transport direction.

A boss 50 formed in a protruding shape is provided to a section of the cutter helical gear 42 other than the rotational center, and is inserted into and engaged with a long hole 49 formed on a handle part 46 of the movable blade 41 (refer to FIG. 8 and FIG. 9). The boss 50 and the long hole 49 constitute conversion device configured to convert the rotation of the above described driving motor 43 in the single direction into an advancing and retreating movement of the movable blade 41. With this arrangement, the rotational motion of the cutter helical gear 42 based on the rotational driving of the driving motor 43 is converted to a motion in the advancing and retreating direction utilizing the engaging structure between the boss 50 and the long hole 49, making it possible to advance and retreat the movable blade 41 with respect to the tape transport path of the label tape 109 with print.

The fixed blade 40 is fixed by screws, etc., through fixing holes on a side plate 44 (refer to FIG. 3) provided in a standing state on the side part of the cartridge holder 6.

As shown in FIG. 8, FIG. 9, etc., the movable blade 41 forms a substantial V-shape, and comprises a blade part 45 provided to the cutting section, the handle part 46 positioned opposite the blade part 45, and an elbow part 47. A shaft hole 48 is provided to the fixed blade. The movable blade 41 is supported by the above described side plate 44 so that it can rotate via a rotating shaft (not shown) provided to the shaft hole 48, using the elbow part 47 as a fulcrum. Further, the above described long hole 49 is formed on the handle part 46 on the side opposite the blade part 45 of the movable blade 41. The blade part 45 is formed by a double-step blade, for example, with the blade surface comprising two inclined surfaces, a first inclined surface and a second inclined surface, with different angles of incline and a thickness of the blade part 45 that gradually decreases.

In the cutting mechanism 15 of the above described configuration, when the cutter helical gear 42 rotates by the driving motor 43, the movable blade 41 oscillates due to the boss 50 and the long hole 49, using the rotating shaft of the above described shaft hole 48 as the fulcrum, and advances toward the transport path of the label tape 109 with print, cutting the label tape 109 with print.

That is, first, when the boss 50 of cutter helical gear 42 is positioned on the inside (the right side in FIG. 8 and FIG. 9), the blade part 45 of the movable blade 41 is positioned away from the fixed blade 40 (initial state). Then, when the driving motor 43 in this initial state drives and the cutter helical gear 42 rotates clockwise in FIG. 8 (the direction of an arrow 70), the boss 50 moves to the outside and the movable blade 41 rotates clockwise in FIG. 8 (in the direction of an arrow 73) around the above described rotating shaft, operates in coordination with the fixed blade 40, and cuts the label tape 109 with print (for details, refer to FIGS. 15-24 described later as well).

Label Discharging Mechanism

On the other hand, the above described label discharging mechanism 22 is provided near the label discharging exit 11 provided to the front wall 10 (refer to FIG. 2) of the apparatus main body 2, and forcibly discharges the label tape 109 with print (in other words, the label L; hereafter the same) from the label discharging exit 11 after being cut by the cutting mechanism 15. That is, the label discharging mechanism 22 is provided further on the downstream side of the tape transport path than the moveable blade 41, and comprises a driving roller 51 for contacting and discharging the label tape 109 with print, and a pressure roller 52 that faces the driving roller 51 with the transport path of the label tape 109 with print therebetween.

The driving roller 51 is rotationally driven by the transmission of the driving force of the above described driving motor 43 to a roller shaft 51*a* by the above described gear train 43A (gear mechanism).

At this time, first guide walls 55 and 56 and second guide walls 63 and 64 for guiding the label tape 109 with print to the label discharging exit 11 (refer to FIG. 3) are provided to the inside of the above described label discharging exit 11. The first guide walls 55 and 56 and the second guide walls 63 and 64 are integrally formed, respectively, and disposed so that they are separated from each other at a predetermined interval at the discharging position of the label tape 109 with print cut by the above described fixed blade 40 and the movable blade 41.

Note that, at this time, a tape guide part 55A comprising a protruding rib shape is provided to the first guide wall 55. This tape guide part 55A fulfills the function of providing guidance so that, in a state where the pressure roller 52 is separated from the tape transport path, the leading edge of the label tape 109 with print and the driving roller 51 (which is in a stopped state since, at this point in time, the movable blade 41 has not yet moved) do not come in contact when the label tape 109 with print is discharged from the cartridge 7. Note that the tape guide part 55A is separately provided in two locations on either side of the driving roller 51 on the first guide wall 55 so that, in a state where the pressure roller 52 contacts the label tape 109 with print on the tape transport path, the insertion of the label tape 109 with print between the driving roller 51 and the pressure roller 52 is not hindered.

Half-Cutting Unit

Next, the detailed structure of the half-cutting unit will be described. As previously described, in the label tape 109 with print, the cover film 103, the adhesive layer 101*a*, the base film 101*b*, the adhesive layer 101*c*, and the separation sheet 101*d* are layered along the layering direction, in that order. Of these layers, the half-cutting unit cuts all layers other than the separation sheet 101*d* (the cover film 103, the adhesive layer 101*a*, the base film 101*b*, and the adhesive layer 101*c*). That is, as shown in FIG. 3, the half-cutting unit comprises, in this example, a receptacle 38 disposed in alignment with the fixed blade 40, a half-cutter 34 configured to cut the layers other than the above described separation sheet 101*d* and disposed on the movable blade 41 side facing the receptacle 38, a first guide part 36 disposed in alignment with the fixed blade 40, between the fixed blade 40 and the receptacle 38, and a second guide part 37 disposed in alignment with the movable blade 41, facing this first guide part 36.

In the above basic configuration, the special characteristics of this embodiment lie in the fact that the rotational driving of the driving roller 51 and the advancing and retreating movement of the blade part 45 of the movable blade 41 are performed by the driving force from the single common driving motor 43. That is, according to this embodiment, the previously described advancing and retreating movement of the blade part 45 of the movable blade 41 with respect to the tape transport path, and the advancing and retreating movement of the pressure roller 52 with respect to the driving roller 51 are adjusted to a preferred mode in coordination with each other, according to the rotation of the driving motor 43 in this single direction. In the following, details on the functions will be described in order.

At the time of the above described coordination, a so-called crank and oscillating lever mechanism that converts rotational motion into advancing and retreating (translational back-and-forth) motion, for example, is used. That is, a substantially inverted triangle shaped support member 60 configured to rotatably support the pressure roller 52 pressed by the driving roller 51 at one end is disposed so that it can rotate (oscillate) via a rotating shaft 163 provided to that end.

The support member 60 is biased by a spring member 62 wound via the rotating shaft 163 so that the rear side that retreats from the tape transport path, that is, the pressure roller 52, is separated from the driving roller 51. Further, a boss 61 of a discharging cam that protrudes toward the movable blade 41 side and is capable of contacting a corner side outer edge 46A of the handle part 46 of the movable blade 41 that is bent in a substantial inverted V shape is provided to the lower end of the support member 60. Based on such a configuration, it is possible to rotate (oscillate) the support member 60 around the rotating shaft 163 by contacting and separating the above described outer edge 46A of the handle part 46 of the movable blade 41 with and from the boss 61 of the discharging cam in coordination with the advancing and retreating movement of the blade part 45 of the movable blade 41 caused by the rotation of the driving motor 43 in the above described single direction.

Based on the above described configuration, the support member 60 is caused to oscillate around the rotating shaft 163 in coordination with the advancing and retreating movement of the movable blade 41, thereby realizing the advancing and retreating movement of the pressure roller 52 with respect to the driving roller 51. That is, the pressure roller 52 is capable of advancing and retreating between the contact position where the driving roller 51 can contact the label tape 109 with print positioned on the tape transport path with the driving roller 51 from the opposite side and insert the label tape 109 with print between itself and the driving roller 51, and the separated position (the entire area from a most separated position to a slightly separated position) where the driving roller 51 separates from the label tape 109 with print positioned on the tape transport path in an amount equivalent to a predetermined distance (for the detailed movement mode, refer to FIGS. 15-24 described later).

Control System

Figure 10:
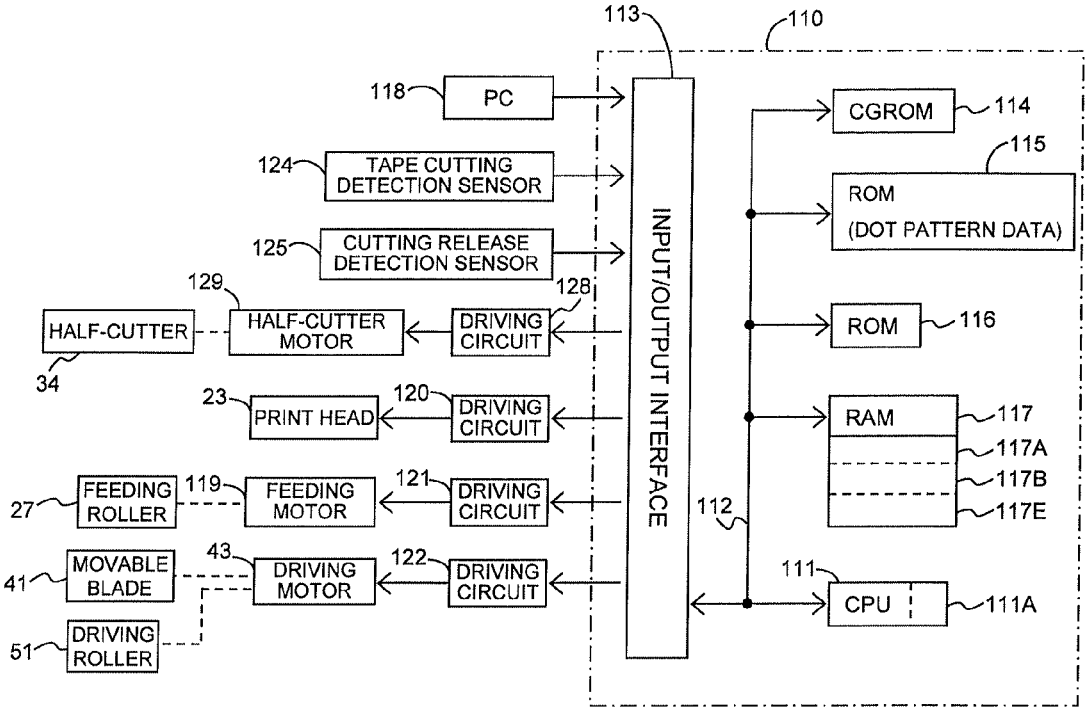
FIG. 10 is a functional block diagram showing the control system of the label producing apparatus.

Next, the control system of the label producing apparatus 1 will be described with reference to FIG. 10. In FIG. 10, a control circuit 110 is disposed on a control board (not shown) of this label producing apparatus 1.

A CPU 111 that internally comprises a timer 111A and is configured to control each device, an input/output interface 113 connected to this CPU 111 via a data bus 112, a CG ROM 114, ROMs 115 and 116, and a RAM 117 are provided to the control circuit 110.

The CG ROM 114 stores dot pattern data corresponding with code data for each of the great number of characters, for example.

The ROM (dot pattern data memory) 115 classifies print dot pattern data on a per font (Gothic font, Ming-style font, etc.) basis, and stores the data correspondingly with the code data on a per font basis for the print character sizes of each font, in relation to the respective great number of characters used for printing characters such as letters, symbols, etc. Additionally, the ROM 115 also stores graphic pattern data for printing graphic images including gradation expressions.

The dot pattern data for display and printing that is stored in the CG ROM 114 and the ROM 115 above can be read from the PC 118 side via the above described communication line NW, and may be displayed on and printed from the PC 118 side that received the data.

The ROM 116 stores a print-head drive control program configured to read print buffer data in relation to the code data of the characters such as the letters and numbers inputted from the above described PC 118, and drive the above described print head 23 and the feeding motor 119, a pulse count determining program configured to determine a pulse count corresponding to the formation energy amount of each print dot, a cutting drive control program configured to drive the feeding motor 119 so as to feed the label tape 109 with print to the cutting position when printing is completed, and subsequently drive the above described driving motor 43 so as to cut the label tape 109 with print, a tape discharging program configured to drive the driving motor 43 so as to forcibly discharge the cut label tape 109 with print (the label L) from the label discharging exit 11, and other various programs required for controlling the label producing apparatus 1. The CPU 111 performs various operations based on such various programs stored in the ROM 116.

The RAM 117 is provided with a text memory 117A, a print buffer 117B, a parameter storage area 117E, and the like. The text memory 117A stores document data inputted from the PC 118. The print buffer 117B stores dot patterns for printing a plurality of characters, symbols, and the like, as dot pattern data, and the print head 23 prints the dots in accordance with the dot pattern data stored in this print buffer 117B. The parameter storage area 117E stores the various operation data.

The PC 118, the above described print-head driving circuit 120 for driving the print head 23, a feeding motor driving circuit 121 for driving the feeding motor 119, a driving circuit 122 for driving the driving motor 43, a half-cutter motor driving circuit 128 for driving a half-cutter motor 129, a tape cutting detection sensor 124, and a cutting release detection sensor 125 are each connected to the input/output interface 113. Note that, in a case where the half-cutter 34 is not provided as previously described, the half-cutter motor 129 and the half-cutter motor driving circuit 128 are omitted.

In such a control system with the control circuit 110 at its core, when character data and the like are inputted via the PC 118, the text (document data) is sequentially stored in the text memory 117A, the print head 23 is driven via the driving circuit 120, and each heating element is selectively exothermically driven in accordance with the print dots of one line so as to print the dot pattern data stored in the print buffer 117B, while the feeding motor 119 synchronously controls the feeding of the tape via the driving circuit 121.

At this time, the tape cutting detection sensor 124 and the cutting release detection sensor 125 comprise a cutter helical gear cam 42A provided so as to protrude in a flange shape in a predetermined circumferential range of the cylindrical outer wall of the cutter helical gear 42, and a micro switch 126, as shown in FIG. 5, FIG. 6, FIG. 8, FIG. 9, etc.

Specifically, in a regular standby state (home position), the micro switch 126 is pressed by the action of the cutter helical gear cam 42A, changing to an ON state (refer to FIG. 15 described later). From this state, when the label tape 109 with print is cut as previously described, the cutter helical gear 42 rotates in a single direction (in the direction of the arrow 70 in FIG. 8) by the driving motor 43, causing the blade part 45 of the movable blade 41 to advance. Subsequently, at the timing in which the cutting of the label tape 109 with print is completed due to the advancing of the blade part 45 of the movable blade 41, the micro switch 126 is no longer pressed since the cutter helical gear cam 42A no longer exists in the circumferential position, and returns from the ON state to the OFF state (refer to FIG. 20 and step S65 of FIG. 14 described later). As a result, completion of the cutting of the label tape 109 with print by the movable blade 41 is detected. The tape cutting detection sensor 124 is configured based on this process.

Figure 14:
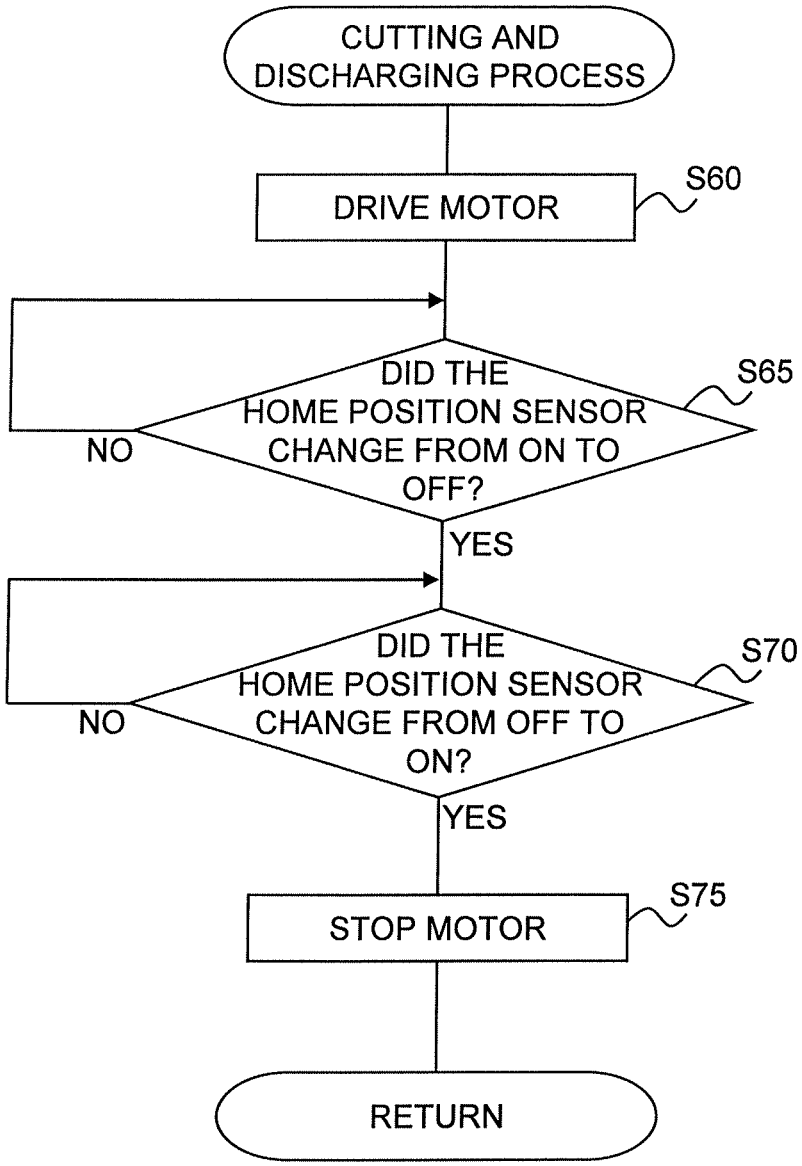
FIG. 14 is a flowchart showing the detailed procedure of step S55.
Figure 24:
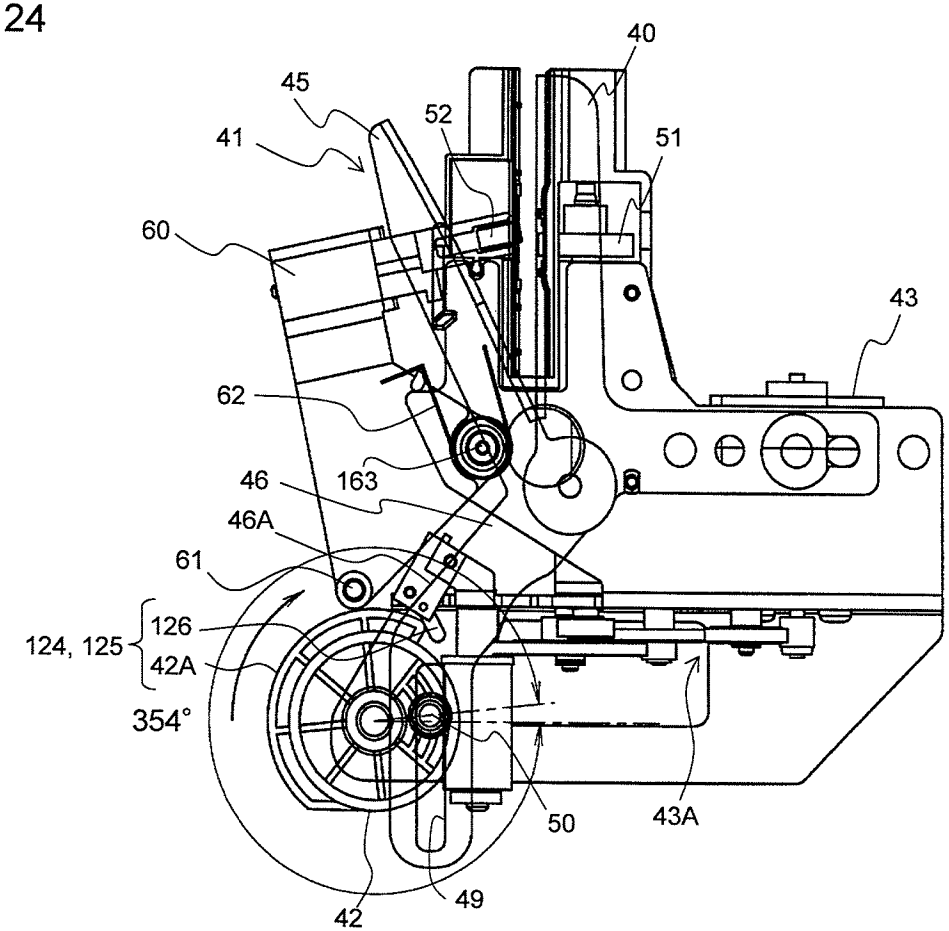
FIG. 24 is a perspective explanatory view for explaining the coordination between the advancing and retreating movement of the movable blade and the advancing and retreating movement of the pressure roller, showing each movement stage.

Further, when the cutter helical gear 42 further rotates in a single direction (in the direction of the arrow 70 of FIG. 8), the cutter helical gear cam 42A once again appears in a certain circumferential position, causing the micro switch 126 to be pressed and switch from the OFF state to the ON state (refer to FIG. 24 and step S70 of FIG. 14 described later). As a result, the return of the movable blade 41 to the above described home position is detected. The cutting release detection sensor 125 is configured based on this process.

Label Configuration

As shown in FIG. 11A, FIG. 11B, FIG. 12A, and FIG. 12B, the label L formed upon completion of the cutting of the label tape 109 with print by the label producing apparatus 1 of a configuration such as previously described comprises a five-layer structure with the cover film 103 added to the four-layer structure shown in FIG. 4 as previously described. That is, the label L is configured with five layers including the cover film 103, the adhesive layer 101*a*, the base film 101*b*, the adhesive layer 101*c*, and the separation sheet 101*d*, from the cover film 103 side (the upper side in FIG. 12) to the opposite side (lower side in FIG. 12). Then, the label print R (the characters "ABCD" in this example) is printed on the back side of the cover film 103.

Further, on the cover film 103, the adhesive layer 101*a*, the base film 101*b*, and the adhesive layer 101*c* are formed half-cut lines HC (two lines in this example: a front half-cut line HC1 and a rear half-cut line HC2) substantially along the tape width direction by the above described half-cutter 34 as already described. On the cover film 103, the area between these half-cut lines HC1 and HC2 is a print area S where the label print R is to be printed, and a front margin area 51 and a rear margin area S2 are respectively formed on either side in the tape longitudinal direction from the print area S, with the half-cut lines HC1 and HC2 therebetween.

Figure 11A:
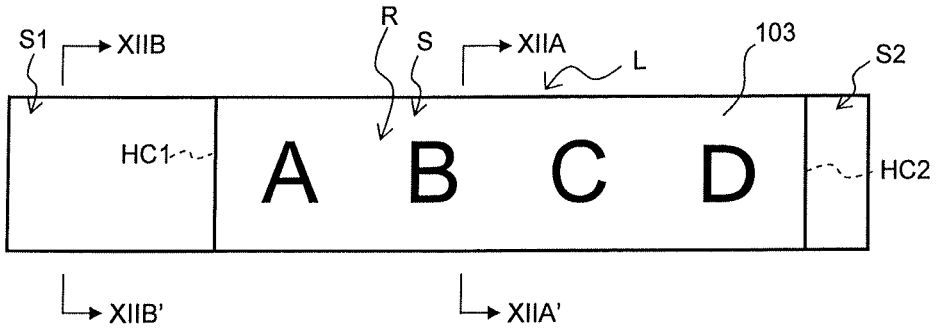
FIG. 11A is a top view showing the outer appearance of an exemplary produced label.
Figure 11B:
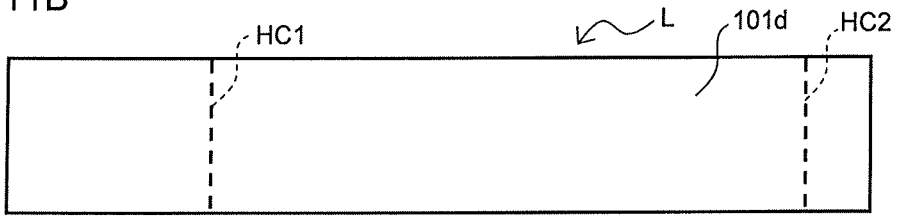
FIG. 11B is a bottom view showing the outer appearance of an exemplary produced label.
Figure 11C:
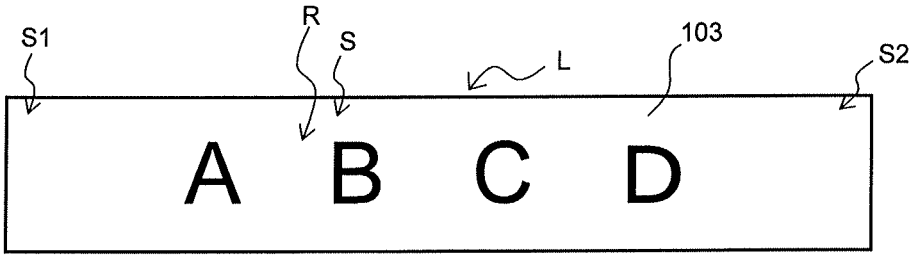
FIG. 11C is a top view showing the outer appearance of an exemplary produced label.
Figure 11D:
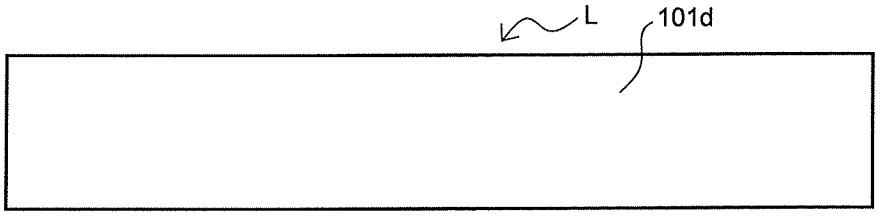
FIG. 11D is a bottom view showing the outer appearance of an exemplary produced label.
Figure 12A:
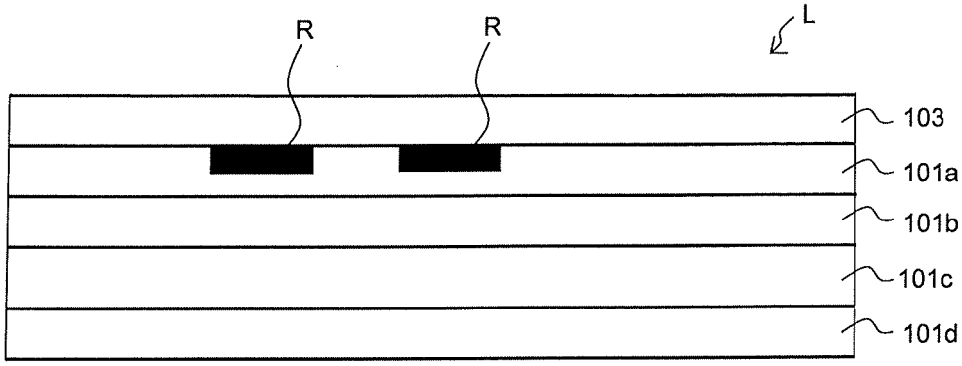
FIG. 12A is a diagram showing the cross-sectional view of the XIIA-XIIA' cross-section.
Figure 12B:
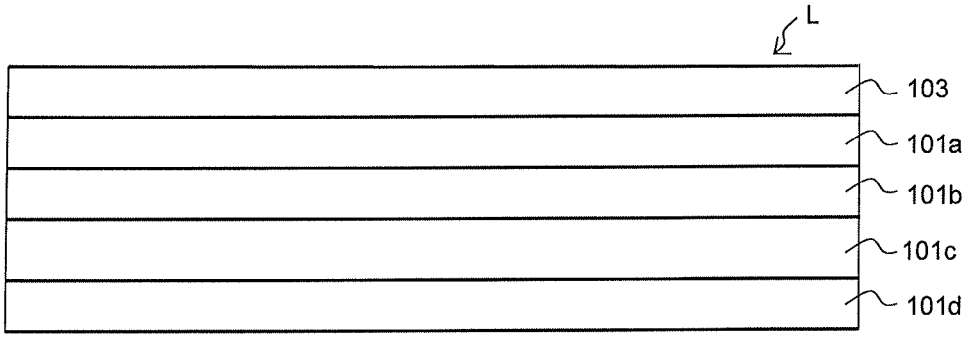
FIG. 12B is a diagram showing the XIIB-XIIB' cross-section in FIG. 11A, rotated 90° counterclockwise.

Note that, in a case where the half-cutting unit is omitted as previously described, the outer appearance changes to one where the above described half-cut lines HC1 and HC2 do not exist, as in FIG. 11C and FIG. 11D respectively corresponding to FIG. 11A and FIG. 11B.

Control Procedure

Next, the control procedure executed by the above described control circuit 110 will be described with reference to FIG. 13.

Figure 13:
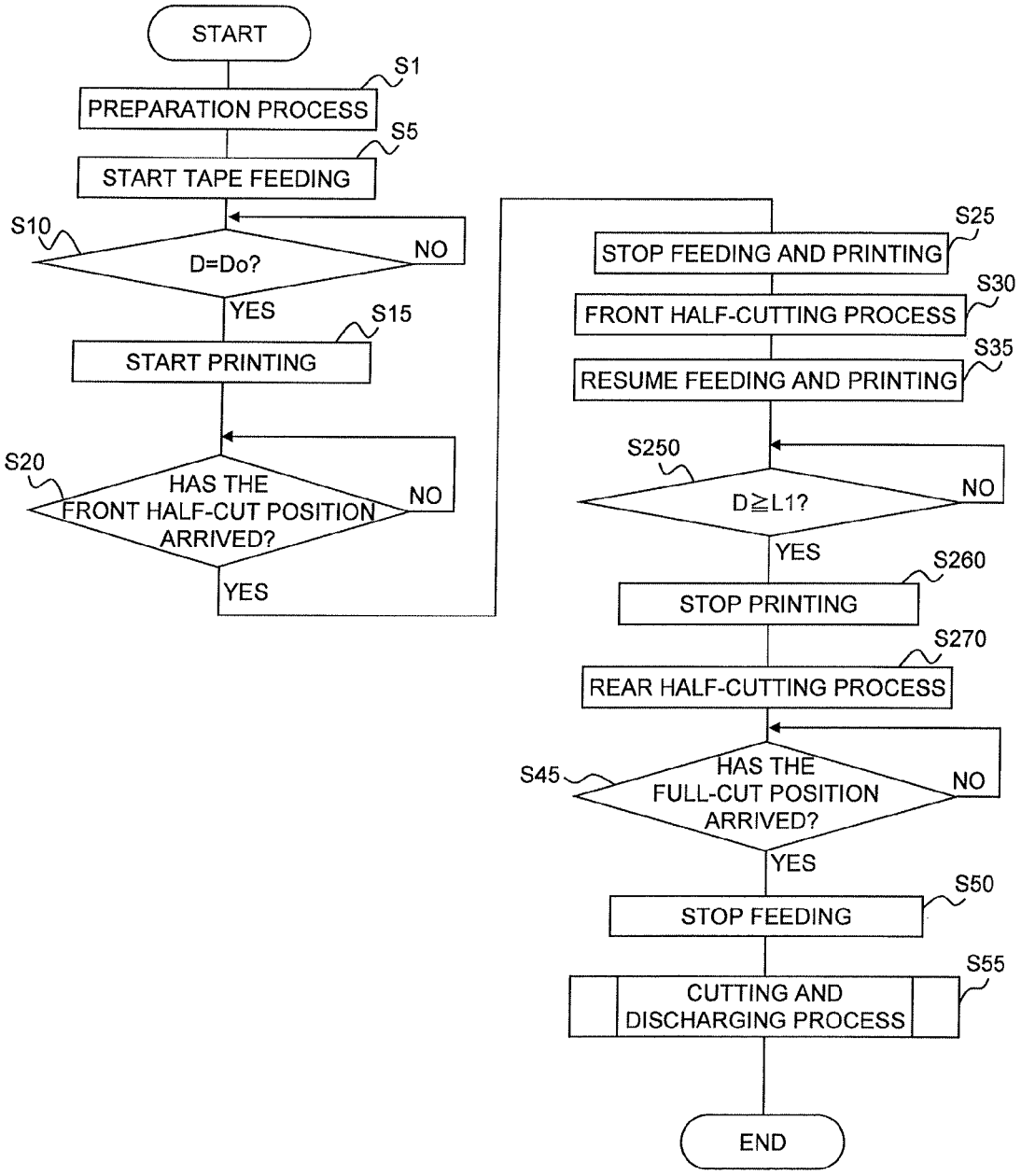
FIG. 13 is a flowchart showing a control procedure executed by the control circuit.

In FIG. 13, the flow starts when a label producing operation is performed using the above described PC 118, for example. First, in step S1, the control circuit 110 inputs an operation signal from the above described PC 118 (via the communication line NW and the input/output interface 113) and, based on this operation signal, executes a preparation process configured to generate print data and set the front/rear half-cut position, the full-cut position, etc. Note that, at this time, a print length L1 described later is included in the above described print data.

In step S5, the control circuit 110 outputs a control signal to the feeding motor driving circuit 121 via the input/output interface 113, causing the feeding roller 27 and the ribbon take-up roller 106 to be rotationally driven by the driving force of the feeding motor 121. With these actions, the base tape 101 is fed out from the first roll 102 and supplied to the feeding roller 27, while the cover film 103 is fed out from the second roll 104. Then, the base tape 101 and the cover film 103 are adhered to each other by the above described feeding roller 27 and the pressure roller 28 so as to form a single tape, thereby forming the label tape 109 with print, which is then fed from the direction outside the cartridge 7 further toward the outside of the label producing apparatus 1.

Subsequently, in step S10, the control circuit 110 determines whether or not a fed distance D by the tape feeding that was started in the above described step S5 has reached a predetermined Do. This Do is a value that determines whether or not the leading edge of the above described print area S in the transport direction has arrived at a position directly opposite the print head 23 based on the aforementioned print data (in other words, whether or not the cover film 103 has arrived at the print start position of the print head 23). The value of Do is determined by the setting of the above described print area S as well as the preparation process of the above described step S1. Until D=Do and the cover film 103 arrives at the print start position, the decision is made that the condition of step S10 is not satisfied, and the sequence loops and enters a standby state. Once the cover film 103 arrives at the print start position, the decision is made that the condition of step S10 is satisfied, and the flow proceeds to step S15.

In step S15, the control circuit 110 outputs a control signal to the print-head driving circuit 120 via the input/output interface 113 so as to supply power to the print head 23 and start the printing of the label print R of the print length L1, such as characters, symbols, barcodes, or the like, corresponding to the print data generated in step S1, in the aforementioned print area S of the cover film 103.

Subsequently, in step S20, the control circuit 110 determines whether or not the label tape 109 with print has been fed to the front half-cut position set in the previous step S1 (in other words, whether or not the label tape 109 with print has arrived at the position where the half-cutter 34 of the half-cutting mechanism 35 is directly opposite the front half-cut line HC1 set in step S1). The decision at this time may be made by simply counting the pulse count output by the feeding motor driving circuit 121 configured to drive the feeding motor 119, which is a pulse motor, after the timing of the above described step S10, and detecting whether or not the pulse count has reached a predetermined value, for example. Until the label tape 109 with print has arrived at the front half-cut position, the decision is made that the condition is not satisfied and this step is repeated. Once the label tape 109 with print arrives at the front half-cut position, the decision is made that the condition is satisfied, and the flow proceeds to step S25.

In step S25, the control circuit 110 outputs a control signal to the feeding motor driving circuit 121 via the input/output interface 113 so as to stop the driving of the feeding motor 119, thereby stopping the rotation of the feeding roller 27 and the ribbon take-up roller 106. With this arrangement, in the process wherein the label tape 109 with print fed out from the cartridge 7 moves in the discharging direction, the feed-out of the base tape 101 from the first roll 102, the feed-out of the cover film 103 from the second roll 104, and the feeding of the label tape 109 with print are stopped with the half-cutter 34 of the half-cutting mechanism 35 directly opposite the front half-cut line HC1 set in step S1. At this time, the control circuit 110 also outputs a control signal to the print-head driving circuit 120 via the input/output interface 113 so as to stop the power supply to the print head 23, thereby stopping (interrupting) the printing of the above described label print R.

Subsequently, in step S30, the control circuit 110 outputs a control signal to the half-cutter motor driving circuit 128 via the input/output interface 113 so as to drive the half-cutter motor 129 and rotate the half-cutter 34, thereby cutting the cover film 103, the adhesive layer 101*a*, the base film 101*b*, and the adhesive layer 101*c* of the label tape 109 with print and performing the front half-cutting process which forms the front half-cut line HC1.

Then, the flow proceeds to step S35 where, similar to the above described step S5, the feeding roller 27 and the ribbon take-up roller 106 are rotationally driven so as to resume the feeding of the label tape 109 with print, and, similar to step S15, power is supplied to the print head 23 so as to resume the printing of the label print R. Note that, in a case where the half-cutter 34 is not provided as previously described, the above described steps S20, S25, S30, and S35 are omitted.

In step S250, the control circuit 110 determines whether or not the fed distance D is greater than or equal to the print length L1, that is, whether or not the rear end of the above described print area S in the transport direction has arrived at a position directly opposite the print head 23 (in other words, whether or not the cover film 103 has arrived at the print start position of the print head 23). This decision at this time can also be made by counting the pulse count that drives the feeding motor 119, as described above. Until D≥L1 and the cover film 103 arrives at the print end position, the decision is made that the condition is not satisfied and this step is repeated. Once the cover film 103 arrives at the print end position, the decision is made that the condition is satisfied, and the flow proceeds to step S260.

In step S260, similar to the above described step S25, the power supply to the print head 23 is stopped, thereby stopping the printing of the above described label print R. As a result, the printing of the label print R in the print area S of the cover film 103 is completed.

Subsequently, the flow proceeds to step S270 where a rear half-cutting process in which the half-cutter 34 of the half-cutting unit 35 forms the rear half-cut line HC2 after tape feeding is performed to the rear half-cut position set in a fixed manner at a predetermined position from the rear end of the above described print area S (set in step S1).

Then, the flow proceeds to step S45 where the control circuit 110 determines whether or not the label tape 109 has arrived at a position where a cut line CL (set in step S1) of the label tape 109 with print is directly opposite the movable blade 41 of the cutting mechanism 15 (in other words, whether or not the label tape 109 with print was fed to the full-cut position). This decision at this time can also be made by counting the pulse count that drives the feeding motor 119, as described above. Until the label tape 109 with print arrives at the full-cut position, the decision is made that the condition is not satisfied and this step is repeated. Once the label tape 109 with print arrives at the full-cut position, the decision is made that the condition is satisfied, and the flow proceeds to step S50.

In step S50, similar to the above described step S25, the rotation of the feeding roller 27 and the ribbon take-up roller 106 is stopped, thereby stopping the feeding of the label tape 109 with print. With this arrangement, the feed-out of the base tape 101 from the first roll 102, the feed-out of the cover film 103 from the second roll 104, and the feeding of the label tape 109 with print are stopped with the movable blade 41 of the cutting mechanism 15 directly opposite the cut line CL set in step S1.

Subsequently, in step S55, the control circuit 110 outputs a control signal to the motor driving circuit 122 so as to drive the driving motor 43 and rotate the movable blade 41 of the cutting mechanism 15, thereby performing a cutting and discharging process wherein the cover film 103, the adhesive layer 101*a*, the base film 101*b*, the adhesive layer 101*c*, and the separation sheet 101*d* of the label tape 109 with print are all cut (scissioned) to form the cut line CL, and the cut label L is discharged (refer to FIG. 14 for details). According to this cutting and discharging process, the label L of a label shape on which desired printing was performed is generated by detaching the label tape 109 with print by the scission performed by the cutting mechanism 15 and then inserting the label tape 109 with print between the driving roller 51 and the pressure roller 52 to discharge the label tape 109 with print. This process then terminates here.

The detailed procedure of the cutting and discharging process of the above described step S55 will now be described with reference to FIG. 14. Note that, as previously described, at the point in time when this flow starts, the movable blade 41 is returned to its home position, and the micro switch 126 of the cutting release detection sensor 125 is pressed by the cutter helical gear cam 42A and already in the ON state.

First, in step S60, the control circuit 110 outputs a control signal to the driving circuit 122 so as to start the driving of the driving motor 43 in the above described single direction. With this arrangement, the cutter helical gear 42 rotates in a corresponding direction, and the cutting of the label tape 109 with print by the movable blade 41 as well as the discharging of the label L by the driving roller 51 and the pressure roller 52 coordinated therewith start (the detailed mode of coordination is described later).

Subsequently, the flow proceeds to step S65 where the control circuit 110 determines whether or not the rotation of the above described cutter helical gear 42 caused the aforementioned cutter helical gear cam 42A to no longer exist, thereby switching the micro switch 126 from the ON state to the OFF state. If the micro switch 126 switched from the ON state to the OFF state, the decision is made that the condition is satisfied and, as previously described, the cutting of the label tape 109 with print by the movable blade 41 is regarded as completed, and the flow proceeds to step S70.

In step S70, the control circuit 110 determines whether or not the cutter helical gear 42 has further rotated, causing the appearance of the aforementioned cutter helical gear cam 42A to switch the micro switch 126 from the OFF state to the ON state. If the micro switch 126 switched from the OFF state to the ON state, the decision is made that the condition is satisfied, the movable blade 41 is regarded as having returned to its home position, and the flow proceeds to step S75.

In step S75, the control circuit 110 outputs a control signal to the driving circuit 122 so as to stop the driving of the driving motor 43. As a result, the rotation of the cutter helical gear 42 stops, and the movable blade 41 changes to a standby state, waiting for the next operation in its home position.

Coordinated Movement of Movable Blade Advancing and Retreating and Pressure Roller Advancing and Retreating Next, the details of the coordination between the aforementioned advancing and retreating movement of the blade part 45 of movable blade 41 with respect to the tape transport path and the advancing and retreating movement of the pressure roller 52 with respect to the driving roller 51 will be described.

According to this embodiment, the most significant characteristics lie in the fact that the above described advancing and retreating movement of the movable blade 41 and the advancing and retreating movement of the pressure roller 52 are coordinated so that the pressure roller 52 contacts the label tape 109 with print for a predetermined time period after the cutting of the label tape 109 with print is completed by the movable blade 41, at the least. In particular, in this example, the above described predetermined time period is configured so that the pressure roller 52 contacts the label tape 109 with print until the rear end of the label L arrives at the driving roller 51.

Then, during the above, until the cutting of the label tape 109 with print is completed by the movable blade 41, at the latest, the pressure roller 52 is configured to advance from the previously described separated position to the tape transport path and contact the label tape 109 with print. Furthermore, until the movable blade 41 contacts and starts cutting the label tape 109 with print positioned on the tape transport path, at the latest, the pressure roller 52 is configured to be in a position retreated from the tape transport path to the rear side.

The following describes the functions of the above described coordination mode in order, based on FIGS. 15-24.

First, the blade part 45 of the movable blade 41 of the cutting mechanism 15 is initially in a standby state (refer to FIG. 15) at its home position, separated from the label tape 109 with print positioned on the transport path, as previously described. In this example, in this state, the boss 50 is in the same horizontal height position as viewed from the center of the cutter helical gear 42. Note that, as previously described, the micro switch 126 of the cutting release detection sensor 125 is already in the ON state at this point in time.

Subsequently, the driving motor 43 starts rotating. This rotational driving force is transmitted to the cutter helical gear 42 via the gear train 43A as previously described, and the rotation of this cutter helical gear 42 causes the blade part 45 of the movable blade 41 to start advancing toward the label tape 109 with print. Further, the above described rotational driving force is transmitted to the roller shaft 51*a* by the above described gear train 43A, causing the driving roller 51 to also start rotating. Note, however, that the outer edge 46A of the handle part 46 of the movable blade 41 is separated from the boss 61 of the support member 60 at this point in time. As a result, since the support member 60 is biased toward the spring member 62, the pressure roller 52 maintains its initial state in which it is retreated rearward from the tape transport path and separated from the driving roller 51. Accordingly, while the driving roller 51 positioned on one side of the label tape 109 with print positioned on the tape transport path is rotating very near the label tape 109 with print, the pressure roller 52 positioned on the other side is separated from the label tape 109 with print, causing the friction force to substantially not act between the label tape 109 with print and the driving roller 51 and the rotation of the driving roller 51 to not be transmitted to the label tape 109 with print (if the driving roller 51 makes contact, the driving roller 51 simply glides over the label tape 109 with print). Accordingly, the label tape 109 with print is not fed in the direction of the label discharging exit 11.

Subsequently, when the cutter helical gear 42 further rotates due to the rotation of the driving motor 43, rotating 85° from the position of the above described home position, the blade part 45 of the movable blade 41 starts cutting the label tape 109 with print (refer to FIG. 16). In this state as well, the outer edge 46A of the movable blade 41 is separated from the boss 61 of the support member 60.

Subsequently, the cutter helical gear 42 further rotates due to the rotation of the driving motor 43, causing the blade part 45 of the movable blade 41 to proceed cutting the label tape 109 with print in the width direction (vertical direction in the figure). Then, when the cutter helical gear 42 rotates 102° from the position of the above described home position, the outer edge 46A of the movable blade 41 contacts the boss 61 of the support member 60 (refer to FIG. 17).

With the above described contact between the outer edge 46A and the boss 61, the support member 60 then starts rotating in the clockwise direction as shown around the rotating shaft 163 as the blade part 45 of the movable blade 41 starts advancing toward the tape transport path. As a result, the pressure roller 52 starts advancing toward the tape transport path, approaching the driving roller 51. Then, when the cutter helical gear 42 further rotates due to the rotation of the driving motor 43, rotating 132° from the position of the above described home position, the pressure roller 52 that advanced as described above contacts the label tape 109 with print. As a result, the label tape 109 with print is inserted between and pressed by the pressure roller 52 and the driving roller 51, and the rotation of the driving roller 51 starts to be transmitted to the label tape 109 with print. Note that, at this point in time, the blade part 45 of the movable blade 41 has cut approximately one-half of the length of the width dimension of the label tape 109 with print, for example, and the remaining approximate one-half remains uncut. That is, the label tape 109 with print is gripped by having been cut into by the blade part 45 of the movable blade 41 partway in the width direction, causing gliding to occur with the driving roller 51 and the label tape 109 with print not be fed in the direction of the label discharging exit 11, even if the rotation of the driving roller 51 is transmitted as described above (refer to FIG. 18).

Subsequently, when the cutter helical gear 42 further rotates due to the rotation of the driving motor 43, causing the blade part 45 of the movable blade 41 to proceed cutting and the cutter helical gear 42 to rotate 170° from the position of the above described home position, the cutting (full-cut) of the entire width dimension of the label tape 109 with print by the blade part 45 of the movable blade 41 is completed (refer to FIG. 19). As a result, the transmission of the rotation of the driving roller 51 by the driving force of the driving motor 43 starts feeding the label tape 109 with print toward the label discharging exit 11. Note that, at this time, the fixed blade 40 and the blade part 45 of the movable blade 41 are in a state of zero overlap in which they are not shearing against each other.

Figure 20:
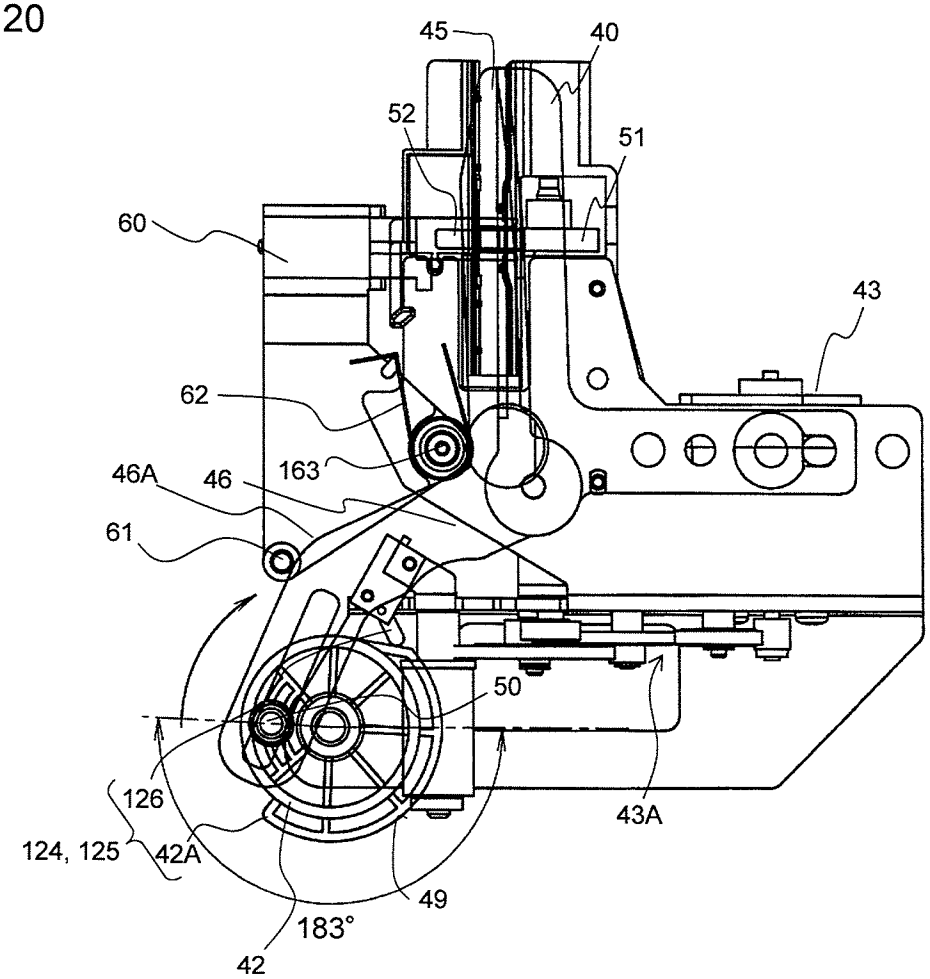
FIG. 20 is a perspective explanatory view for explaining the coordination between the advancing and retreating movement of the movable blade and the advancing and retreating movement of the pressure roller, showing each movement stage.

Subsequently, when the cutter helical gear 42 further rotates due to the rotation of the driving motor 43, rotating 183° from the position of the above described home position, the cutter helical gear cam 42A of the cutter helical gear 42 that had pressed the micro switch 126 up to this time disappears (or its height decreases; refer to FIG. 20). As a result, the micro switch 126 switches to the OFF state, and the above described control circuit detects the completion of the cutting of the label tape 109 with print (refer to step S65 of FIG. 14).

Figure 21:
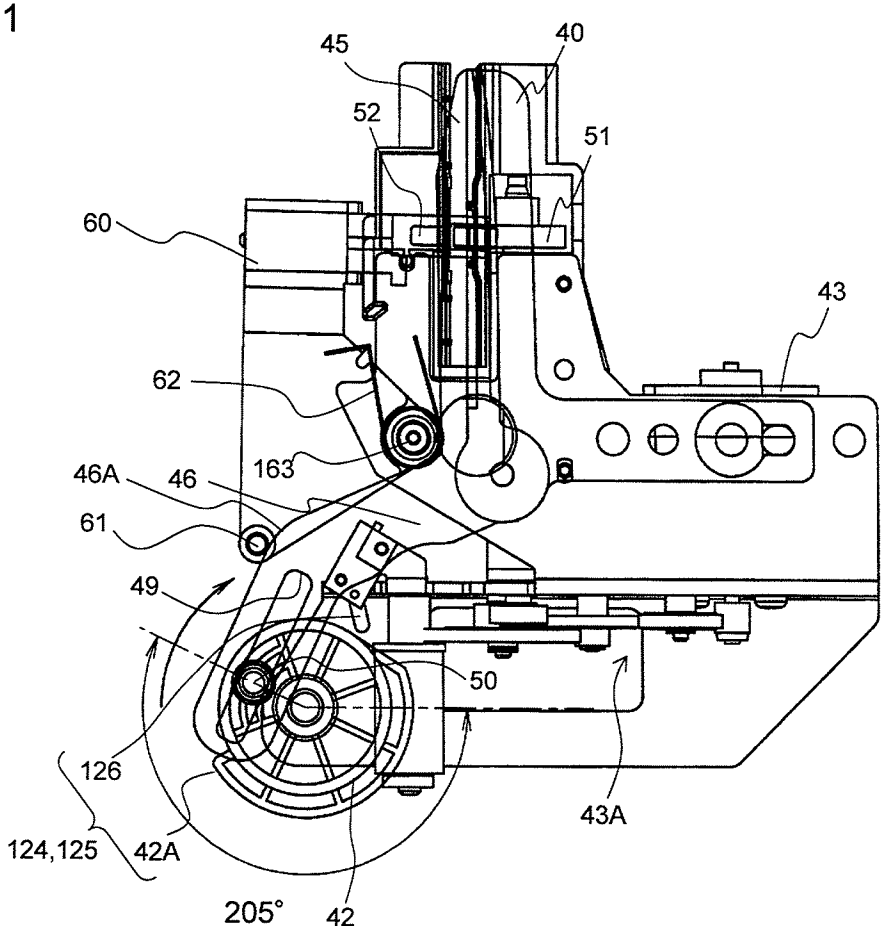
FIG. 21 is a perspective explanatory view for explaining the coordination between the advancing and retreating movement of the movable blade and the advancing and retreating movement of the pressure roller, showing each movement stage.
Figure 22:
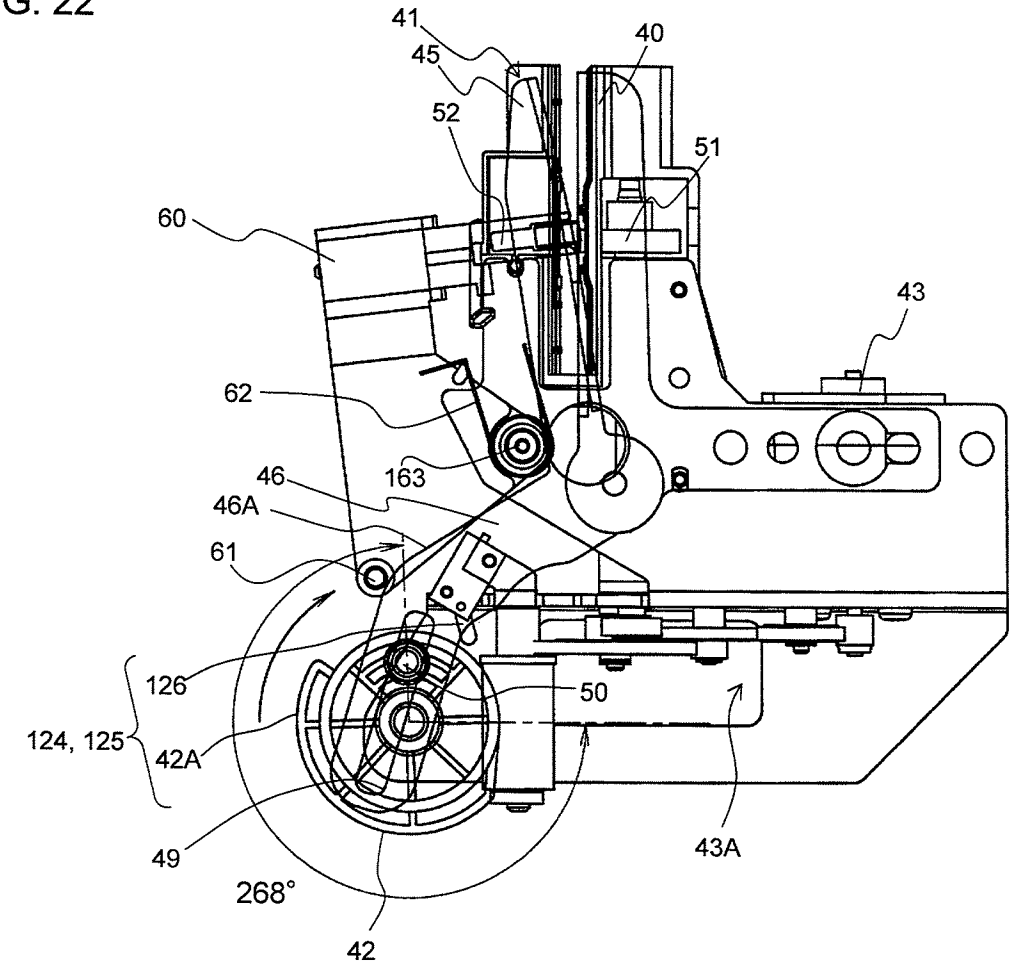
FIG. 22 is a perspective explanatory view for explaining the coordination between the advancing and retreating movement of the movable blade and the advancing and retreating movement of the pressure roller, showing each movement stage.
Figure 23:
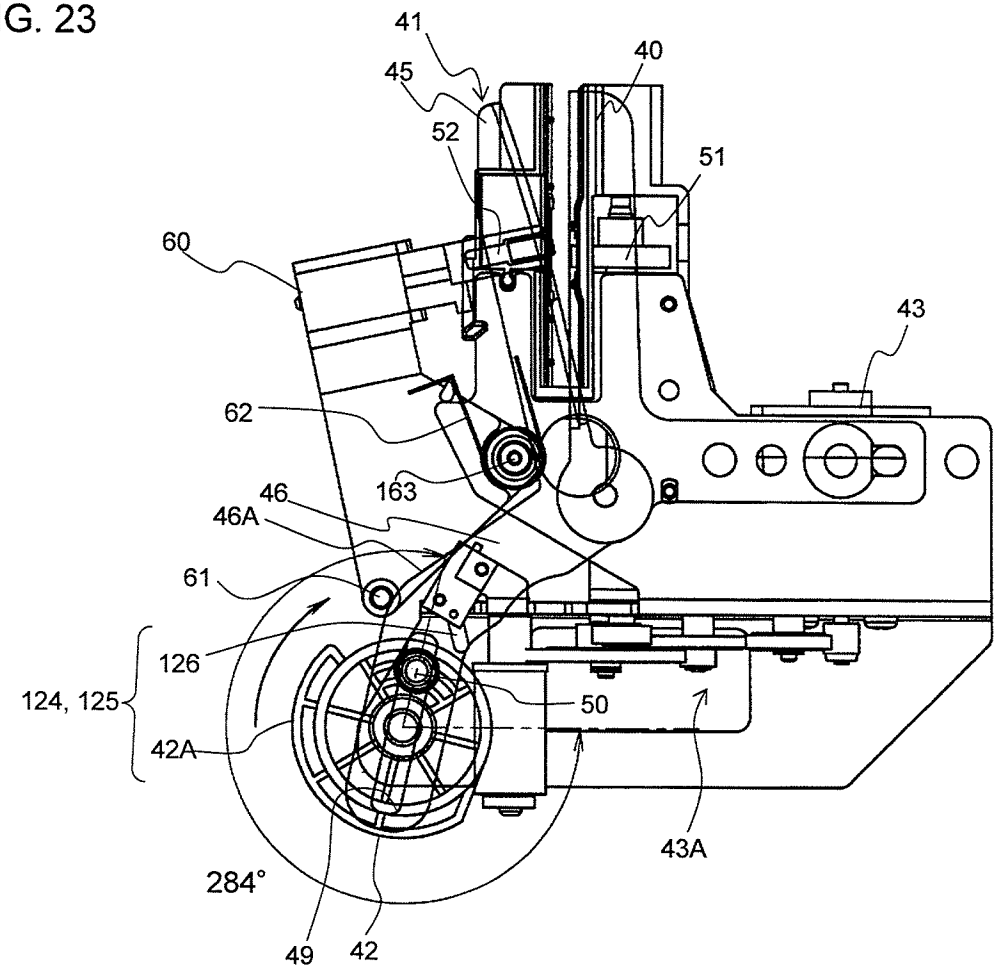
FIG. 23 is a perspective explanatory view for explaining the coordination between the advancing and retreating movement of the movable blade and the advancing and retreating movement of the pressure roller, showing each movement stage.

Subsequently, when the cutter helical gear 42 further rotates due to the rotation of the driving motor 43, rotating 205° from the position of the above described home position, the fixed blade 40 and the blade part 45 of the movable blade 41 shear against each other, overlapping a predetermined amount (refer to FIG. 21).

Subsequently, when the cutter helical gear 42 further rotates due to the rotation of the driving motor 43, the movable blade 41 starts rotating around the above described rotating shaft from a certain point in time in a direction that causes the blade part 45 to separate from the tape transport path (in the counterclockwise direction in the figure) by the action of the shape and orientation of the long hole 49 of the handle part 46 of the movable blade 41. As a result, the blade part 45 starts to separate from the label tape 109 with print. Further, with this, the support member 60 that caused the boss 61 to contact the above described outer edge 46A of the movable blade 41 and had integrally oscillated therewith starts rotating in the direction opposite the direction until then (the counterclockwise direction in the figure), around the above described rotating shaft 163 as well. Then, when the cutter helical gear 42 rotates 268° from the position of the above described home position, the pressure roller 52 supported by the support member 60 separates rearward away from the tape transport path of the label tape 109 with print (to the left side in the figure) due to the rotation of the above described support member 60 in the opposite direction (refer to FIG. 22). That is, the feeding rate as well as the shape, dimension, material, and the like of each component are set so that, once the rotation of the driving roller 51 caused by the driving force of the driving motor 43 is transmitted and the feeding of the label tape 109 with print starts in FIG. 19, at least the rear end of the label L generated by the cutting of the label tape 109 with print arrives at the position of the driving roller 51 within the period up to the state in FIG. 22, thereby causing the label L to be reliably discharged from the label discharging exit 11.

Subsequently, when the cutter helical gear 42 further rotates due to the rotation of the driving motor 43, causing the blade part 45 of the movable blade 41 to further retreat and separate from the tape transport path and the cutter helical gear 42 to rotate 284° from the position of the above described home position, the support member 60 returns to its initial state corresponding to the aforementioned home position. As a result, the contact between the outer edge 46A of the movable blade 41 and the boss 61 of the support member 60 hereinafter terminates and the outer edge 46A separates from the boss 61.

Subsequently, when the cutter helical gear 42 further rotates due to the rotation of the driving motor 43, rotating 354° from the position of the above described home position, the cutter helical gear cam 42A of the cutter helical gear 42 appears (or its height increases), pressing and changing the micro switch 126 to the ON state. With this arrangement, the above described control circuit detects that the movable blade 41 has returned to the above described home position (refer to step S70 of FIG. 14).

As described above, in this embodiment, the rotational driving of the driving roller 51 and the advancing and retreating movement of the moveable blade 41 are performed by the driving force from the single common driving motor 43. The driving roller 51 is directly connected to and rotates with the rotational driving of the driving motor 43 in a single direction, and thus always rotates when the driving motor 43 is rotationally driven. The pressure roller 52 is provided so that it can advance and retreat to and from the transport path of the label tape 109 with print. When the pressure roller 52 advances and contacts the label tape 109 with print on the transport path, it inserts the label tape 109 with print between itself and the pressure roller 51. As a result, the rotational driving force of the driving roller 51 acts on the label tape 109 via a friction force, feeding the label tape 109 in the discharging direction. Conversely, when the pressure roller 52 is in a position separated from the label tape 109 with print, that rotational driving force is not transmitted to the label tape 109 and the label tape 109 is not discharged, even if the driving roller 51 has rotated due to the rotational driving of the driving motor 43 as described above.

On the other hand, the cutting of the label tape 109 with print by the advancing and retreating movement of the moveable blade 41 with respect to the tape transport path is also performed by utilizing the driving force of the driving motor 43 such as described above. However, since it is difficult to cut the label tape 109 with print while the label tape 109 with print is moving, the label tape 109 with print must be completely stopped and not moving during cutting. In response, the above described advancing and retreating movement of the pressure roller 52 and the movable blade 41 is mutually coordinated as previously described with respect to the driving roller 51 that always rotates when the driving motor 43 is rotating.

Figure 16:
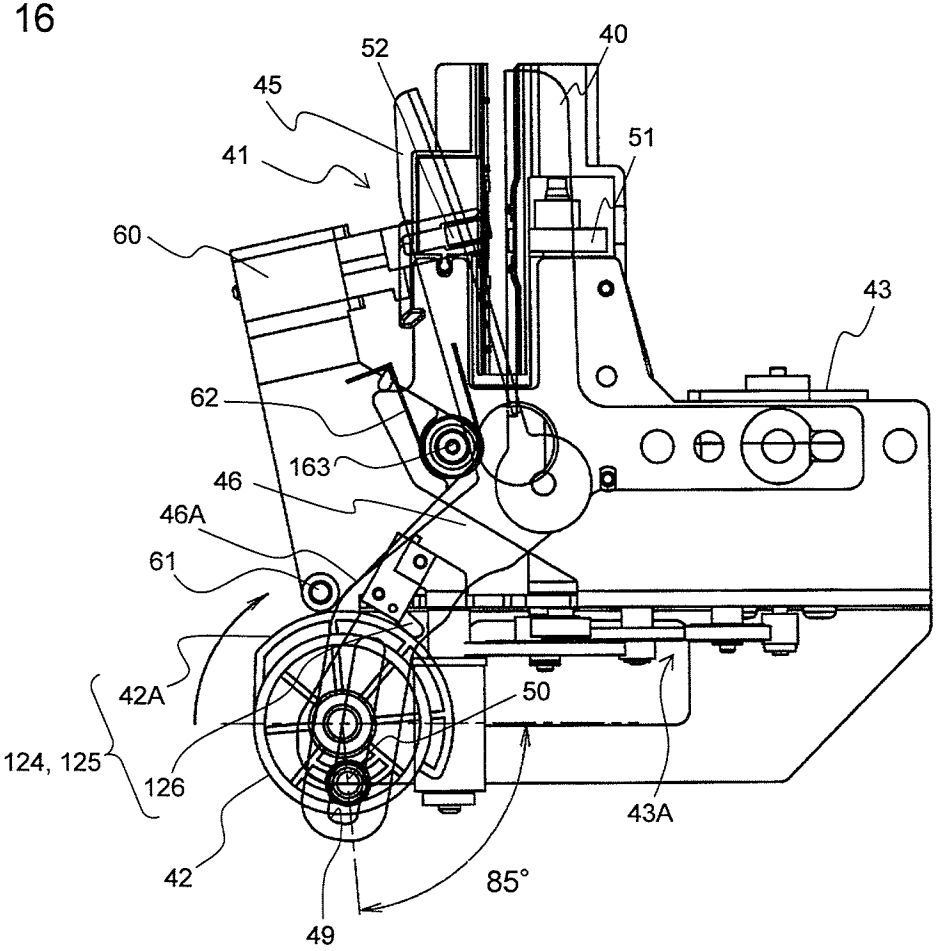
FIG. 16 is a perspective explanatory view for explaining the coordination between the advancing and retreating movement of the movable blade and the advancing and retreating movement of the pressure roller, showing each movement stage.
Figure 17:
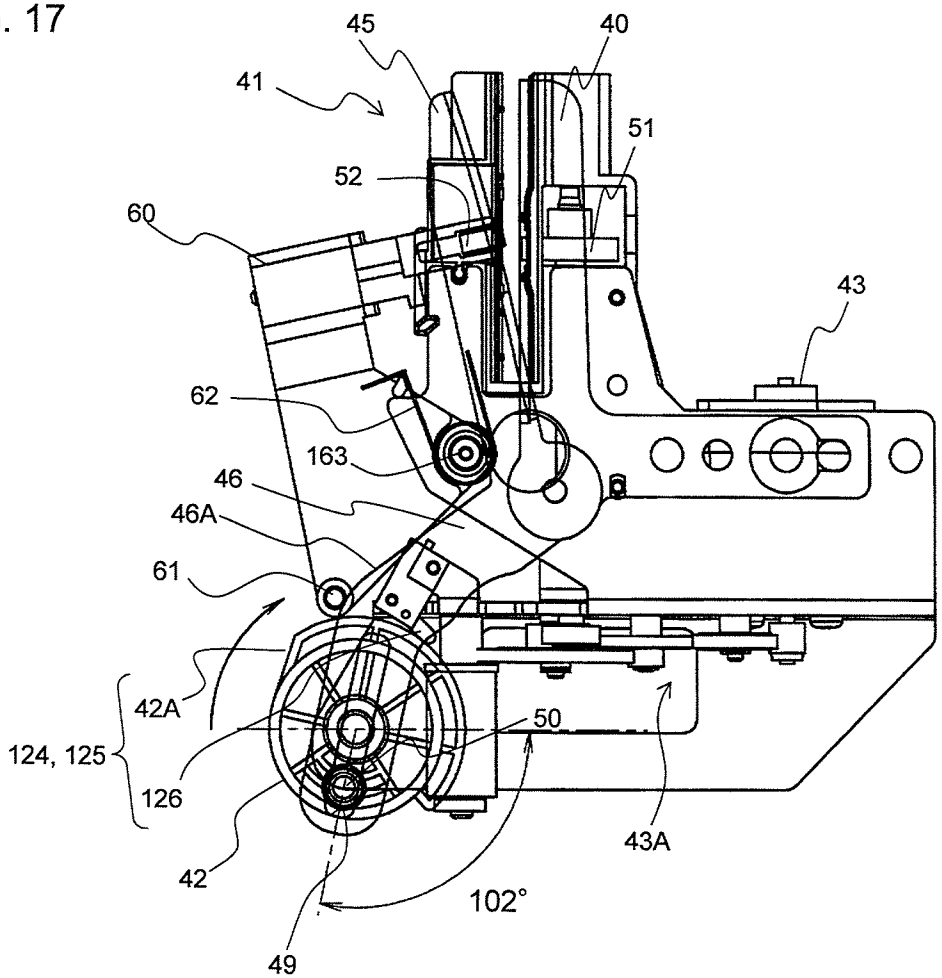
FIG. 17 is a perspective explanatory view for explaining the coordination between the advancing and retreating movement of the movable blade and the advancing and retreating movement of the pressure roller, showing each movement stage.
Figure 18:
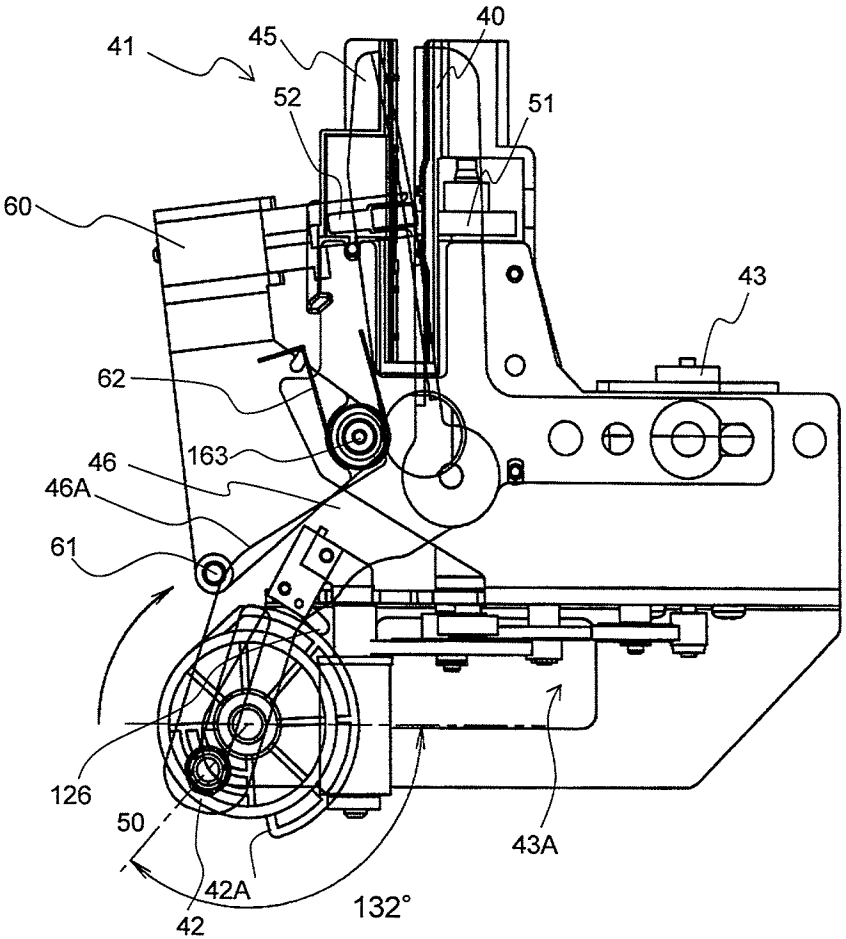
FIG. 18 is a perspective explanatory view for explaining the coordination between the advancing and retreating movement of the movable blade and the advancing and retreating movement of the pressure roller, showing each movement stage.

That is, during cutting, the label tape 109 with print is not inserted between the pressure roller 52 and the driving roller 51 to the extent possible, and the driving force is not transmitted to the label tape 109 with print to the extent possible (from the state of FIG. 16 to the state immediately prior to that of FIG. 18). With this arrangement, it is possible to perform cutting smoothly. Further, when tape cutting is completed, the label tape 109 with print is inserted between the pressure roller 52 and the driving roller 51, and the driving force is transmitted to the label tape 109 with print (from the state of FIG. 19 to the state immediately prior to that of FIG. 22). With this arrangement, it is possible to feed out the cut label tape 109 with print, that is, the label L, in the discharging direction. Further, after cutting is completed, the contact between the pressure roller 52 and the label tape 109 with print is maintained for a predetermined time period (until the state immediately prior to that of FIG. 22), causing the discharging movement of the above described label L to continue for a predetermined time period. As a result, the label L generated by the above described cutting can be reliably discharged to outside the apparatus by sufficiently lengthening the predetermined time period.

As described above, in this embodiment, it is possible to smoothly and reliably cut the label tape 109 with print by the movable blade 41 and subsequently discharge the label L utilizing the driving force of the single common driving motor 43. Accordingly, compared to a case where two motors, a motor for driving the movable blade 41 and a motor for discharging the label L, are provided separately, it is possible to decrease the number of motors. As a result, the size and weight of the overall apparatus can be reduced, and a cost reduction can also be achieved.

Further, the pressure roller 52 and the movable blade 41 advance and retreat in coordination so that the pressure roller 52 is in the contact position for a period from cutting completion of the label tape 109 with print by the movable blade 41 to the arrival of the label L rear end at the driving roller 51 as the predetermined time period. With this arrangement, it is possible to reliably discharge the label L generated by the cutting to outside the apparatus.

Figure 19:
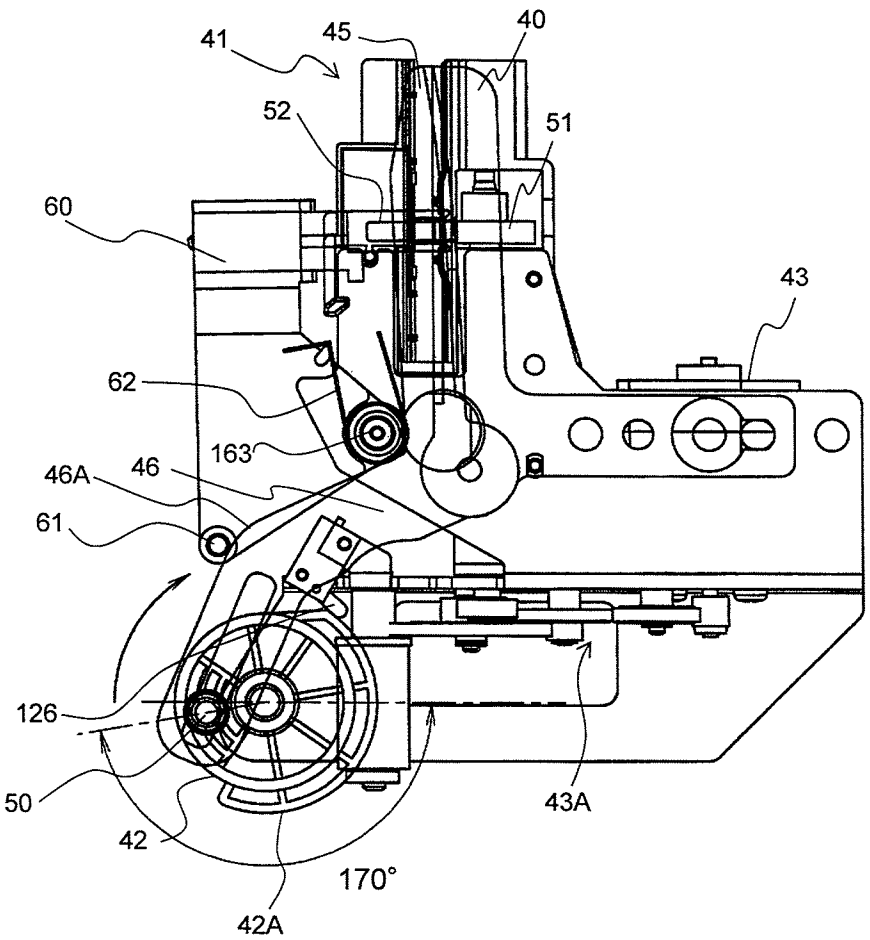
FIG. 19 is a perspective explanatory view for explaining the coordination between the advancing and retreating movement of the movable blade and the advancing and retreating movement of the pressure roller, showing each movement stage.

Furthermore, by the time the movable blade 41 completes cutting the label tape 109 with print, at the latest, the pressure roller 52 and the movable blade 41 are caused to advance and retreat in coordination so that the pressure roller 52 advances from the separated position and contacts the label tape 109 with print (in this example, the pressure roller 52 contacts the label tape 109 with print in the state of FIG. 18 prior to the state of FIG. 19 where the cutting of the label tape 109 with print is completed). With this arrangement, by the time the tape cutting is completed, at the least, the label tape 109 with print is inserted between the pressure roller 52 and the driving roller 51, making it possible to transmit the driving force of the driving roller 51 to the label tape 109 with print and promptly start the feeding of the cut label tape 109 with print, that is, the label L, in the discharging direction in a reliable manner.

Figure 15:
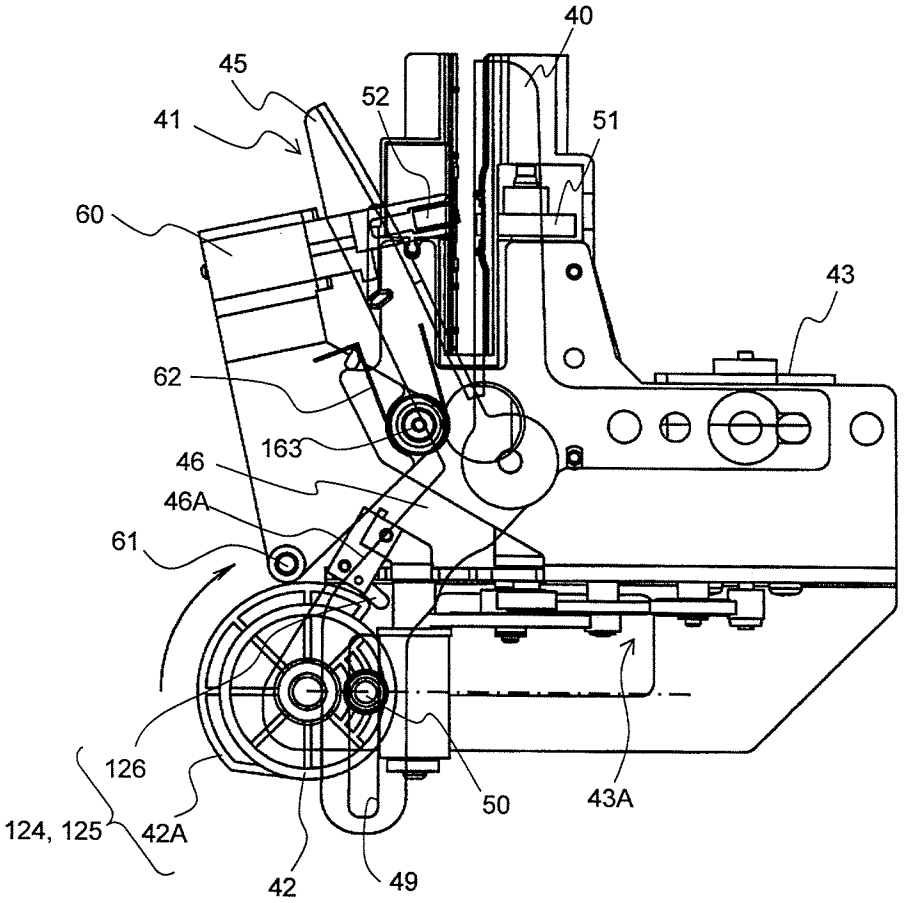
FIG. 15 is a perspective explanatory view for explaining the coordination between the advancing and retreating movement of the movable blade and the advancing and retreating movement of the pressure roller, showing each movement stage.

Further, by the time the movable blade 41 contacts and starts cutting the label tape 109 with print positioned on the tape transport path, at the latest, the pressure roller 52 and the movable blade 41 are caused to advance and retreat in coordination so that the pressure roller 52 separates from the transport path of the label tape 109 with print (in this example, the pressure roller 52 is already separated from the transport path of the label tape 109 with print in the state of FIG. 15 prior to the state of FIG. 16 in which cutting is started). With this arrangement, when the motor rotates in a single direction and the movable blade 41 advances toward the label tape 109 with print side positioned on the tape transport path, the pressure roller 52 is separated from the label tape 109 with print. With this arrangement, by the time cutting starts, at the least, the label tape 109 with print is not inserted between the pressure roller 52 and the driving roller 51, making it possible to not transmit the driving power of the driving roller 51 that rotates in accordance with the rotation of the above described motor to the label tape 109 with print. As a result, it is possible to reliably and smoothly start cutting.

Further, in particular, according to this embodiment, the tape guide part 55A is provided. With the guide function of this tape guide part 55A, even when the leading edge of the label tape 109 with print fed on the tape transport path arrives at the position of the driving roller 51, the label tape 109 with print does not contact the driving roller 51 (in a rotation stopped state prior to the start of the cutting movement of the movable blade 41), as previously described. Accordingly, it is possible to reliably prevent the occurrence of feeding failures and tape jams caused by the label tape 109 with print getting caught due to contact with the driving roller 51.

Note that the present disclosure is not limited to the above described embodiment, and various modifications may be made without deviating from the spirit and scope of the disclosure.

(1) When the Roller is Driving During Introduction of the Label Tape

That is, in the above described embodiment, the guide part 55A is provided so that feeding failures and tape jams do not occur due to contact with the driving roller 51 when the leading edge of the label tape 109 with print fed on the tape transport path arrives at the position of the driving roller 51. According to this modification, instead of the provision of this guide part 55A, the driving roller 51 is driven at a predetermined timing close to when the leading edge of the label tape 109 with print arrives at the position of the driving roller 51 (in advance of the timing at which the cutting by the movable blade 41 is performed).

Specifically, according to this modification, control is performed so that the driving motor 43 is rotated in a single direction in a time range around when the leading edge of the fed label tape 109 with print arrives near the driving roller 51, within a predetermined time range when the advancing and retreating movable blade 41 does not contact and start cutting the label tape 109 with print, i.e., in the range where the above described cutter helical gear 42 is at a slight rotational angle from the position of the above described home position, for example. The control procedure executed by the above described control circuit 110 of this modification will now be described with reference to FIG. 25 and FIG. 26.

Figure 25:
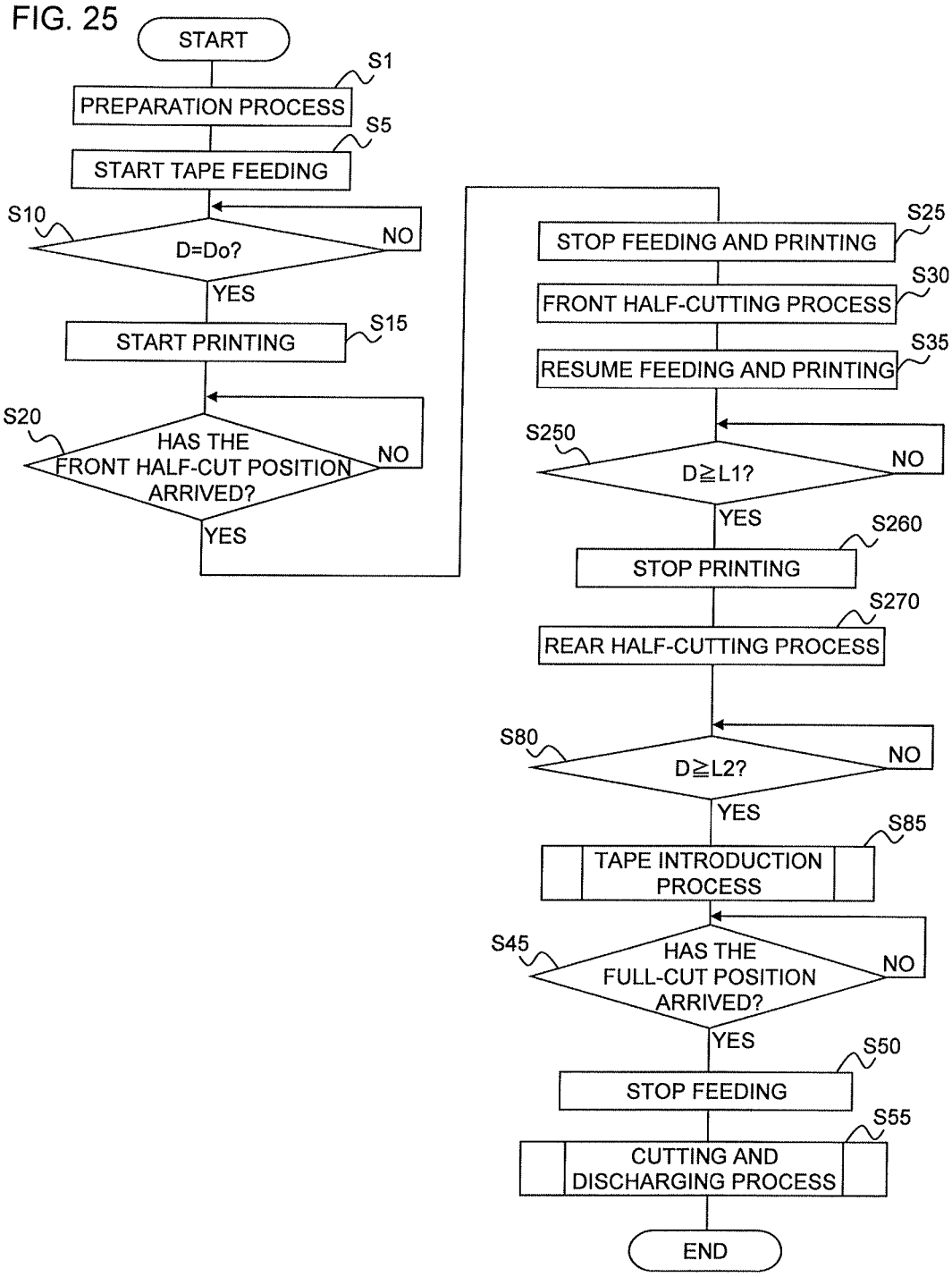
FIG. 25 is a flowchart showing the control procedure of a modification in which the driving roller is driven in advance of the timing of the cutting performed by the movable blade.

In FIG. 25, the flow of this modification differs in that step S80 and step S85 are newly provided between step S270 and step S45 of the flow of FIG. 13.

That is, when the rear half-cutting process ends in step S270 as described above, the flow proceeds to the newly provided step S80. In step S80, the control circuit 110 determines whether or not the fed distance D is equivalent to a distance L2 or greater. This distance L2 is a distance along the transport path of the label tape 109 with print, from the movable blade 41 of the cutting mechanism 15 to the driving roller 51, and is stored in a suitable location (in the ROM 116, etc.) as a specific value in the label producing apparatus 1 in advance.

With this arrangement, the control circuit 110 determines whether or not the leading edge of the label tape 109 with print in the transport direction has arrived at the position of the driving roller 51. This decision at this time can also be made by counting the pulse count that drives the feeding motor 119, as previously described, for example. Until D≥L2, the decision is made that the condition is not satisfied and the step is repeated. When D≥L2, the decision is made that the condition is satisfied and the flow proceeds to step S85.

In step S85, a tape introduction process in which the control circuit 110 outputs a control signal to the motor driving circuit 122 so as to drive the driving motor 43, causing the driving roller 51 to rotate for a predetermined time period (described later) and thus smoothly introduce the leading edge of the label tape 109 with print along the transport path is performed (for details, refer to FIG. 26). The subsequent steps S45 and thereafter are the same as those of FIG. 13, and descriptions thereof will be omitted.

Figure 26:
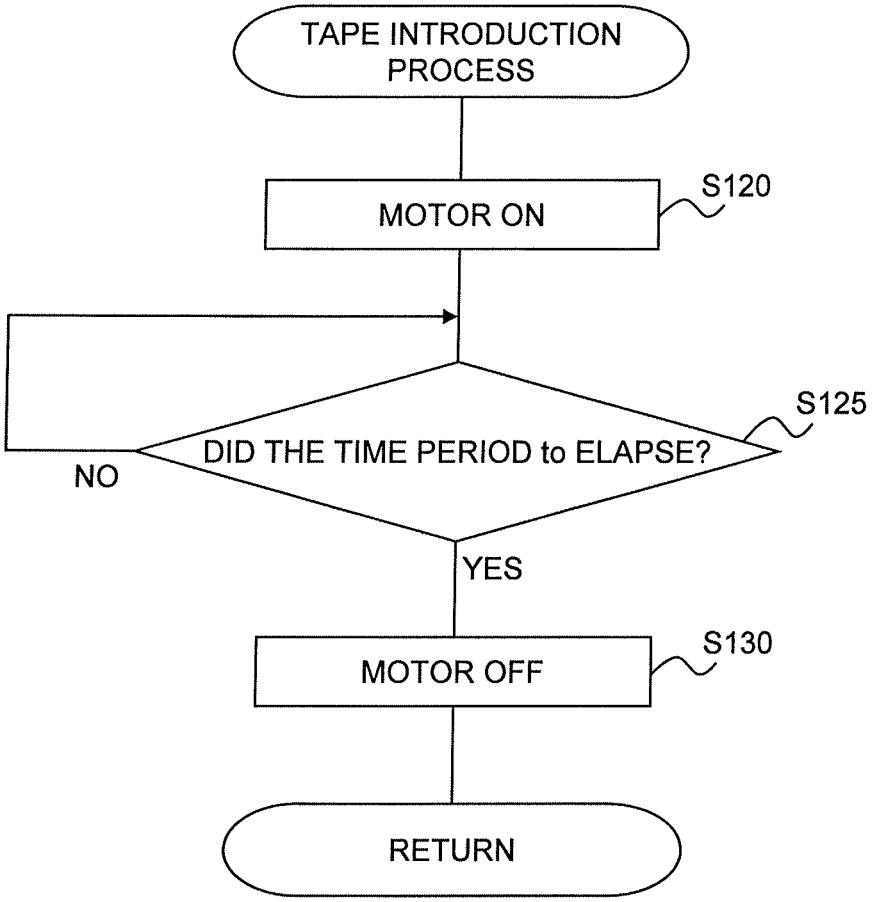
FIG. 26 is a flowchart showing the detailed procedure of step S85.

FIG. 26 shows the detailed procedure of step S85. As previously described, at the point in time in which this flow starts, the movable blade 41 is returned to its home position. In FIG. 26, first, in step S120, the control circuit 110 outputs a control signal to the driving circuit 122 so as to start the driving of the driving motor 43 in the above described single direction. As a result, the rotation of the driving roller 51 starts.

Subsequently, the flow proceeds to step S125 where the control circuit 110 determines whether or not a predetermined time period to (for example, to=100 msec) defined in advance has elapsed since the above described step S120. If to has elapsed, the decision is made that the condition is satisfied, and the flow proceeds to step S130.

In step S 130, the control circuit 110 outputs a control signal to the driving circuit 122, stopping the driving of the driving motor 43. As a result, the rotation of the driving roller 51 stops. With the above, when the leading edge of the label tape 109 with print in the transport direction arrives at the position of the driving roller 51, the driving roller 51 rotates for a period equivalent to the time period to.

Note that the cutter helical gear 42 rotates from the home position in an amount equivalent to a predetermined angle range as previously described due to the driving of the driving motor 43 of this time period to and, as a result, the blade part 45 of the movable blade 41 moves slightly from the home position to the transport path side of the label tape 109 with print. Accordingly, in the subsequent cutting and discharging process of step S55 of FIG. 25, the process is started from this slightly moved state.

According to this modification, when the leading edge of the label tape 109 with print fed on the tape transport path arrives at the position of the driving roller 51, the driving roller 51 rotates based on the control of the driving motor 43, making it possible to smoothly bring in the label tape 109 with print while contacting the leading edge. As a result, it is possible to reliably prevent the occurrence of feeding failures and tape jams caused by the label tape 109 with print contacting and getting caught on the driving roller 51 in a stopped state. At this time, the above described control rotates the driving motor 43 for rotating the above described driving roller 51 for a time period restricted to a predetermined time period range to around when the leading edge of the label tape 109 with print arrives near the driving roller 51 as described above. With this arrangement, is it possible to prevent the movable blade 41 from mistakenly contacting and starting to cut the label tape 109 with print, based on the rotation of the motor for bringing in the above described tape leading edge.

(2) Other

While the above employs a method wherein printing is performed on the cover film 103 separate from the base tape 101 and then the two are bonded together, the present disclosure is not limited thereto. For example, the present disclosure may also be applied to a method (a type that does not perform bonding) wherein printing is performed on the print-receiving tape layer provided to the base tape.

Further, while in the above the label producing apparatus 1 is connected to the PC 118 via the communication line NW, the present disclosure is not limited thereto. That is, all of the functions of the above described PC 118, etc., may be provided to the label producing apparatus 1 side (in other words, a stand-alone type label producing apparatus is acceptable).

Further, the arrows shown in FIG. 10, etc., denote an example of signal flow, but the signal flow direction is not limited thereto.

Also note that the present disclosure is not limited to the procedure illustrated in the above described flowcharts of the above described FIG. 13, FIG. 14, FIG. 25, FIG. 26, etc., and additions and deletions as well as sequence changes to the procedure may be made without deviating from the spirit and scope of the disclosure.

Further, other than that already stated above, techniques based on the above described embodiments and each of the modifications may be suitably utilized in combination as well.

Although other examples are not individually described herein, various changes can be made according to the present disclosure without deviating from the spirit and scope of the disclosure.

What is claimed is:

1. A label producing apparatus comprising:

a cartridge holder capable of attaching and detaching a cartridge configured to supply a label tape;

a feeder configured to pull out and feed said label tape from said cartridge mounted to said cartridge holder;

a movable blade configured to advance and retreat with respect to a tape transport path by said feeder, and cut said label tape fed by said feeder at a desired length;

a driving roller configured to contact and discharge said label tape, provided further on a downstream side than said movable blade on said tape transport path;

a driven roller provided so that it can advance and retreat between a contact position where it can contact said label tape positioned on said tape transport path with said driving roller from an opposite side and insert said label tape between itself and said driving roller, and a separated position where it separates from said label tape positioned on said tape transport path in an amount equivalent to a predetermined distance;

a motor configured to rotate in a single direction only and generate a driving force for an advancing and retreating movement of said movable blade with respect to said tape transport path, and a rotational movement of said driving roller;

a gear mechanism configured to transmit said driving force of said motor to said driving roller so that said driving roller rotates along with a rotational movement of said motor; and an advancing and retreating adjustment device configured to adjust an advancing and retreating movement of said driven roller with respect to said driving roller and an advancing and retreating movement of said movable blade with respect to said tape transport path, associated with a rotation of said motor in said single direction, to a desired mode in coordination with each other, said advancing and retreating adjustment device advancing and retreating said driven roller and said movable blade in coordination so that said driven roller is in said contact position for a predetermined time period after cutting of said label tape is completed by said movable blade, wherein said advancing and retreating adjustment device comprises:

a conversion device configured to convert the rotation of said motor in said single direction to said advancing and retreating movement of said movable blade a coordination device configured to rotate a support member around a predetermined rotational center in coordination with said advancing and retreating movement of said movable blade by the rotation of said motor in said single direction, said coordination device comprising:

said support member configured to rotatably support said driven roller, and capable of rotating with respect to said predetermined rotational center.

2. The label producing apparatus according to claim 1, wherein:

said advancing and retreating adjustment device advances and retreats said driven roller and said movable blade in coordination so that said driven roller is in said contact position for said predetermined time period from cutting completion of said label tape by said movable blade to an arrival of a rear end of a label at said driving roller.

3. The label producing apparatus according to claim 1, wherein:

said advancing and retreating adjustment device advances and retreats said driven roller and said movable blade in coordination so that, by the time said movable blade completes cutting said label tape, at the latest, said driven roller has advanced from said separated position and arrived at said contact position.

4. The label producing apparatus according to claim 1, wherein:

said advancing and retreating adjustment device advances and retreats said driven roller and said movable blade in coordination so that, by the time said movable blade contacts and starts cutting said label tape positioned on said tape transport path, at the latest, said driven roller is in said separated position.

5. The label producing apparatus according to claim 1, wherein:

said conversion device comprises:

a movable blade driving gear configured to rotate in a corresponding single direction in association with the rotation of said motor in said single direction;

a first pin provided to a portion of said movable blade driving gear other than a rotational center; and an engaging hole configured to engage with said first pin while allowing a back-and-forth movement of said first pin, provided to a base part of said movable blade.

6. The label producing apparatus according to claim 5, wherein:

said coordination device comprises:

a second pin capable of contacting an outer edge of said movable blade, provided to said support member and protruding toward said movable blade side.

7. The label producing apparatus according to claim 1, further comprising a printing head configured to perform desired printing on said label tape fed by said feeder prior to arrival at a cutting position where cutting is performed by said movable blade, wherein:

said movable blade cuts said label tape after printing by said printing head, thereby producing a print label.

8. A label producing apparatus comprising:

a cartridge holder capable of attaching and detaching a cartride configured to supply a label tape;

a feeder configured to pull out and feed said label tape from said cartridge mounted to said cartridge holder;

a movable blade configured to advance and retreat with respect to a tape transport path by said feeder, and cut said label tape fed by said feeder at a desired length;

a driving roller configured to contact and discharge said label tape, provided further on a downstream side than said movable blasé on said tape transport path;

a driven roller provided so that it can advance and retreat between a contact position where it can contact said label tape positioned on said tape transport path with said driving roller from an opposite side and insert said label tape between itself and said driving roller, and a separated position where it separates from said label tape positioned on said tape transport path in an amount equivalent to a predetermined distance;

a motor configured to rotate in a single direction only and generate a driving force for an advancing and retreating movement of said movable blade with respect to said tape transport path, and a rotational movement of said driving roller;

a gear mechanism configured to transmit said driving force of said motor to said driving roller so that said driving roller rotates along with a rotational movement of said motor; and an advancing and retreating adjustment device configured to adjust an advancing and retreating movement of said driven roller with respect to said driving roller and an advancing and retreating movement of said movable blade with respect to said tape transport path, associated with a rotation of said motor in said single direction, to a desired mode in coordination with each other, said advancing and retreating adjustment device advancing and retreating said driven roller and said movable blade in coordination so that said driven roller is in said contact position for a predetermined time period after cutting of said label tape is completed by said movable blade, wherein the label producing apparatus further comprises:

a tape guide member configured to guide said label tape so that said insertion of said label tape positioned on said tape transport path between said driving roller and said driven roller is not hindered in a state where said driven roller is in said contact position, and said label tape positioned on said tape transport path does not contact said driving roller in a state where said driven roller is not in said contact position, and wherein said driving roller is disposed in a position where the driving roller is evacuated inward than said tape guide member so that said label tape is not in contact with a circumference surface of said driving roller when said label tape has arrived near the driving roller.

9. The label producing apparatus according to claim 1, further comprising:

a motor control part configured to execute control so that said motor rotates in said single direction within a predetermined time range when said movable blade that performs said advancing and retreating contacts said label tape and does not start cutting said label tape, said predetermined time range being around when a leading edge of said label tape fed by said feeder arrives near said driving roller.

10. The label producing apparatus according to claim 8, further comprising:

a motor control part configured to execute control so that said motor rotates in said single direction within a predetermined time range when said movable blade that performs said advancing and retreating contacts said label tape and does not start cutting said label tape, said predetermined time range being around when a leading edge of said label tape fed by said feeder arrives near said driving roller.

11. The label producing apparatus according to claim 8, further comprising a printing head configured to perform desired printing on said label tape fed by said feeder prior to arrival at a cutting position where cutting is performed by said movable blade; wherein:

said movable blade cuts said label tape after printing by said printing head, thereby producing a print label.

* * * * *